US011680581B2

(12) United States Patent
Jukes et al.

(10) Patent No.: US 11,680,581 B2
(45) **Date of Patent: *Jun. 20, 2023**

(54) NOZZLE FOR A FAN ASSEMBLY

(71) Applicant: Dyson Technology Limited, Wiltshire (GB)

(72) Inventors: Timothy Neil Jukes, Swindon (GB); Neil Ewen Callum MacQueen, Bristol (GB); Charles Edward Pouget, Swindon (GB); Joseph Eric Hodgetts, Bristol (GB); Philip Tennison Reilly, Oxford (GB); Adam Pinkstone, Gloucester (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/824,048

(22) Filed: May 25, 2022

(65) Prior Publication Data

US 2022/0290686 A1 Sep. 15, 2022

Related U.S. Application Data

(63) Continuation of application No. 17/254,719, filed as application No. PCT/GB2019/051715 on Jun. 19, 2019, now Pat. No. 11,486,413.

(30) Foreign Application Priority Data

Jun. 27, 2018 (GB) ..... 1810541

(51) Int. Cl.
*F04D 29/40* (2006.01)
*F04D 29/26* (2006.01)
(Continued)

(52) U.S. Cl.
CPC ..... *F04D 29/403* (2013.01); *F04D 25/08* (2013.01); *F04D 25/10* (2013.01); *F04D 29/26* (2013.01); *F04F 5/16* (2013.01)

(58) Field of Classification Search
CPC ..... F04D 29/403; F04D 29/26; F04D 25/08; F04D 25/10; F04F 5/16
See application file for complete search history.

(56) References Cited

U.S. PATENT DOCUMENTS 2,488,467 A 11/1949 Salvatore
3,362,494 A * 1/1968 Boehler ..... B60V 1/04 180/128
(Continued)

FOREIGN PATENT DOCUMENTS

CN 2185861 Y 12/1994
CN 1993243 A 7/2007
(Continued)

OTHER PUBLICATIONS

Evaluation Report dated Aug. 10, 2020, directed to CN Application No. ZL2019209769775; 13 pages.
(Continued)

*Primary Examiner* — Syed O Hasan
(74) *Attorney, Agent, or Firm* — Faegre Drinker Biddle & Reath LLP

(57) ABSTRACT

There is provided a nozzle for a fan assembly. The nozzle comprises an air inlet, a first air outlet for emitting an air flow and a second air outlet for emitting an air flow, the first and second air outlets together defining an aggregate air outlet of the nozzle, a single internal air passageway extending between the air inlet and the first and second air outlets, and a valve for controlling an air flow from the air inlet to the first and second air outlets. The valve comprises one or more valve members that are moveable to adjust the size of the first air outlet relative to the size of the second air outlet
(Continued)

while keeping the size of the aggregate air outlet of the nozzle constant, and wherein the air outlets are oriented towards a convergent point.

18 Claims, 16 Drawing Sheets

(51) Int. Cl.

| | |
|---|---|
| ***F04D 25/08*** | (2006.01) |
| ***F04D 25/10*** | (2006.01) |
| *F04F 5/16* | (2006.01) |

(56) References Cited

U.S. PATENT DOCUMENTS

| | | | | |
|---|---|---|---|---|
| 3,823,653 | A | 7/1974 | Roos | |
| 4,395,201 | A | 7/1983 | Bron | |
| 5,411,371 | A | 5/1995 | Chen | |
| 5,524,827 | A | 6/1996 | Znamensky et al. | |
| 5,821,475 | A | 10/1998 | Morehead et al. | |
| 6,156,085 | A | 12/2000 | Chiu et al. | |
| 8,308,445 | B2 | 11/2012 | Gammack et al. | |
| 2008/0014855 | A1 | 1/2008 | Leserre | |
| 2009/0047892 | A1 | 2/2009 | Brancheriau et al. | |
| 2010/0014959 | A1* | 1/2010 | Azzouz | B60H 1/3435 415/126 |
| 2012/0034108 | A1 | 2/2012 | Wallace et al. | |
| 2012/0051884 | A1 | 3/2012 | Junkel et al. | |
| 2013/0280051 | A1 | 10/2013 | Nicolas et al. | |
| 2014/0255173 | A1* | 9/2014 | Poulton | F04D 25/08 415/182.1 |
| 2014/0286747 | A1 | 9/2014 | Fang et al. | |
| 2014/0348658 | A1 | 11/2014 | Cunnane | |
| 2016/0121695 | A1 | 5/2016 | Sakurai | |
| 2016/0152116 | A1 | 6/2016 | Albin et al. | |
| 2017/0190240 | A1* | 7/2017 | Paris | B60H 1/345 |
| 2018/0080676 | A1 | 3/2018 | Cho et al. | |
| 2021/0270282 | A1 | 9/2021 | MacQueen | |
| 2021/0270283 | A1 | 9/2021 | MacQueen | |
| 2021/0270284 | A1 | 9/2021 | Jukes et al. | |
| 2021/0270292 | A1 | 9/2021 | MacQueen | |
| 2021/0381518 | A1 | 12/2021 | Horton et al. | |
| 2023/0028614 | A1 | 1/2023 | Marcel et al. | |

FOREIGN PATENT DOCUMENTS

| | | | | |
|---|---|---|---|---|
| CN | 101649842 | A | 2/2010 | |
| CN | 101985949 | A | 3/2011 | |
| CN | 102235385 | A | 11/2011 | |
| CN | 103133300 | A | 6/2013 | |
| CN | 203272264 | U | 11/2013 | |
| CN | 103807149 | A | 5/2014 | |
| CN | 203627312 | U | 6/2014 | |
| CN | 203770175 | U | 8/2014 | |
| CN | 204084763 | U | 1/2015 | |
| CN | 104895768 | A | 9/2015 | |
| CN | 105041625 | A | 11/2015 | |
| CN | 105508311 | A | 4/2016 | |
| CN | 105644302 | A | 6/2016 | |
| CN | 106123272 | A | 11/2016 | |
| CN | 106286327 | A | 1/2017 | |
| CN | 206035913 | U | 3/2017 | |
| CN | 106573522 | A | 4/2017 | |
| CN | 106884815 | A | 6/2017 | |
| CN | 106969482 | A | 7/2017 | |
| CN | 207317217 | U | 5/2018 | |
| CN | 210829911 | U | 6/2020 | |
| CN | 211174828 | U | 8/2020 | |
| CN | 211231040 | U | 8/2020 | |
| CN | 211343521 | U | 8/2020 | |
| CN | 211901107 | U | 11/2020 | |
| DE | 10350949 | A1 | 11/2004 | |
| DE | 102015001477 | A1 | 12/2015 | |
| DE | 102015116242 | B3 | 9/2016 | |
| DE | 102016107227 | A1 | 10/2017 | |
| EP | 0610866 | A1 | 8/1994 | |
| EP | 3321114 | A1 | 5/2018 | |
| EP | 3321114 | A1 * | 5/2018 | B60H 1/3414 |
| FR | 2772311 | A1 | 6/1999 | |
| FR | 3034175 | A1 | 9/2016 | |
| GB | 1347978 | A | 2/1974 | |
| GB | 2463698 | A | 3/2010 | |
| GB | 2482549 | A | 2/2012 | |
| GB | 2493672 | A | 2/2013 | |
| GB | 2496464 | A | 5/2013 | |
| GB | 2499042 | A | 8/2013 | |
| GB | 2502103 | A | 11/2013 | |
| JP | 61-195235 | U | 12/1986 | |
| JP | 2009-204240 | A | 9/2009 | |
| JP | 2012-145308 | A | 8/2012 | |
| JP | 2014-088774 | A | 5/2014 | |
| JP | 2014-234936 | A | 12/2014 | |
| JP | 5663051 | B2 | 2/2015 | |
| JP | 2015-175309 | A | 10/2015 | |
| KR | 10-0225915 | B1 | 10/1999 | |
| KR | 10-1601325 | B1 | 3/2016 | |
| KR | 10-1647382 | B1 | 8/2016 | |
| KR | 10-1735432 | B1 | 5/2017 | |
| TW | 336963 | B | 7/1998 | |
| WO | 99/07569 | A1 | 2/1999 | |
| WO | 2010/100451 | A1 | 9/2010 | |
| WO | 2013/035271 | A1 | 3/2013 | |
| WO | 2014/075399 | A1 | 5/2014 | |
| WO | 2017/050754 | A1 | 3/2017 | |
| WO | 2018/058892 | A1 | 4/2018 | |
| WO | 2020/089581 | A1 | 5/2020 | |

OTHER PUBLICATIONS

Evaluation Report dated Jul. 15, 2020, directed to CN Application No. ZL201920977040X; 13 pages.

Evaluation Report dated Nov. 16, 2020, directed to CN Application No. ZL2019218644124; 13 pages.

Evaluation Report of Patentability of Utility Model dated Nov. 11, 2020, directed to CN Application No. ZL201920989943X; 14 pages.

International Search Report and Written Opinion dated Dec. 17, 2019, directed to International Application No. PCT/GB2019/052834; 11 pages.

International Search Report and Written Opinion received for PCT Patent Application No. PCT/GB2019/051712, dated Sep. 24, 2019, 9 pages.

International Search Report and Written Opinion received for PCT Patent Application No. PCT/GB2019/051713, dated Sep. 25, 2019, 9 pages.

International Search Report and Written Opinion received for PCT Patent Application No. PCT/GB2019/051714, dated Sep. 24, 2019, 9 pages.

International Search Report and Written Opinion received for PCT Patent Application No. PCT/GB2019/051715, dated Oct. 2, 2019, 8 pages.

Office Action received for Chinese Patent Application No. 201910559580.0, dated Jul. 2, 2021, 22 pages (14 pages of English Translation and 8 pages of Original Document).

Office Action received for Chinese Patent Application No. 201910566663.2, dated Jul. 2, 2021, 25 pages (15 pages of English Translation and 10 pages of Original Document).

Search Report dated Apr. 30, 2019, directed to GB Application No. 1817852.5; 1 page.

Search Report dated Dec. 10, 2018, directed to GB Application No. 1810538.7; 1 page.

Search Report dated Dec. 10, 2018, directed to GB Application No. 1810539.5; 1 page.

Search Report dated Dec. 19, 2018, directed to GB Application No. 1810540.3; 1 page.

Search Report dated Dec. 19, 2018, directed to GB Application No. 1810541.1; 1 page.

The First Office Action dated Dec. 7, 2020, directed to CN Application No. 201910559831.5; 18 pages.

(56) References Cited

OTHER PUBLICATIONS

The First Office Action dated May 6, 2021, directed to CN Application No. 201911050925.6; 15 pages.
The First Office Action dated Oct. 12, 2020, directed to CN Application No. 201910559580.0; 16 pages.
The First Office Action dated Oct. 12, 2020, directed to CN Application No. 201910566663.2; 13 pages.
Singapore Search Report and Written Opinion Received for SG Application No. 11202009931S, dated May 20, 2022, 8 pages.
Office Action received for Patent Application No. KR 10-2021-7000200, dated May 20, 2022, 13 pages (7 pages of English Translation and 6 pages of Original Document).
Office Action received for Patent Application No. KR 10-2021-7000470, dated May 20, 2022, 11 pages (6 pages of English Translation and 5 pages of Original Document).
Fei et al., WO 2018/058892, 2018, English Machine Translation (Year: 2018).

* cited by examiner

NOZZLE FOR A FAN ASSEMBLY

REFERENCE TO RELATED APPLICATIONS

This application is a continuation of U.S. patent application Ser. No. 17/254,719, filed Dec. 21, 2020, which is a national phase application under 35 USC 371 of International Application No. PCT/GB2019/051715, filed Jun. 19, 2019, which claims the priority of United Kingdom Application No. 1810541.1, filed Jun. 27, 2018, the entire contents of each of which is incorporated herein by reference.

FIELD OF THE DISCLOSURE

The present invention relates to a nozzle for a fan assembly, and a fan assembly comprising such a nozzle.

BACKGROUND OF THE DISCLOSURE

A conventional domestic fan typically includes a set of blades or vanes mounted for rotation about an axis, and drive apparatus for rotating the set of blades to generate an airflow. The movement and circulation of the airflow creates a 'wind chill' or breeze and, as a result, the user experiences a cooling effect as heat is dissipated through convection and evaporation. The blades are generally located within a cage which allows an airflow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an airflow into the base, and a series of concentric, annular nozzles connected to the base and each comprising an annular outlet located at the front of the nozzle for emitting the airflow from the fan. Each nozzle extends about a bore axis to define a bore about which the nozzle extends.

Each nozzle is in the shape of an airfoil may therefore be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the airflow in a direction extending away from the nozzle and along the chord line.

Another fan assembly which does not use caged blades to project air from the fan assembly is described in WO 2010/100451. This fan assembly comprises a cylindrical base which also houses a motor-driven impeller for drawing a primary airflow into the base, and a single annular nozzle connected to the base and comprising an annular mouth/outlet through which the primary airflow is emitted from the fan. The nozzle defines an opening through which air in the local environment of the fan assembly is drawn by the primary airflow emitted from the mouth, amplifying the primary airflow. The nozzle includes a Coanda surface over which the mouth is arranged to direct the primary airflow. The Coanda surface extends symmetrically about the central axis of the opening so that the airflow generated by the fan assembly is in the form of an annular jet having a cylindrical or frusto-conical profile.

The user is able to change the direction in which the air flow is emitted from the nozzle in one of two ways. The base includes an oscillation mechanism which can be actuated to cause the nozzle and part of the base to oscillate about a vertical axis passing through the centre of the base so that that air flow generated by the fan assembly is swept about an arc of around 180°. The base also includes a tilting mechanism to allow the nozzle and an upper part of the base to be tilted relative to a lower part of the base by an angle of up to 10° to the horizontal.

SUMMARY OF THE DISCLOSURE

According a first aspect there is provided a nozzle for a fan assembly. The nozzle comprises an air inlet, a first air outlet for emitting an air flow and a second air outlet for emitting an air flow, the first and second air outlets together defining an aggregate air outlet of the nozzle, a single internal air passageway extending between the air inlet and the first and second air outlets, and a valve for controlling an air flow from the air inlet to the first and second air outlets. The valve comprises one or more valve members that are moveable to adjust the size of the first air outlet relative to the size (i.e. open area) of the second air outlet while keeping the size of the aggregate air outlet of the nozzle constant, and the air outlets are oriented towards a convergent point. In other words, the valve is arranged such that movement of the one or more valve members simultaneously adjusts the size of the first air outlet and inversely adjusts the size of the second air outlet whilst keeping the aggregate size of the first and second air outlets constant. The first and second air outlets are discrete. In other words, the first air outlet and the second air outlet are physically separated from. one another.

The present invention provides a nozzle which is capable of receiving input of a single air flow, e.g. from a single air supply source, and manipulating the air flow such that the direction of the air flow emitted from the nozzle may be changed without the need to oscillate or tilt the assembly to which the nozzle is attached. The first air outlet emits a first air flow and the second air outlet emits a second air flow. The total air flow emitted from the nozzle, which is a combination of the first air flow and the second air flow, remains constant, but through varying the proportion of the total air flow emitted through each of the first and second air outlets, the profile of the air flow emitted from the nozzle can be changed.

The one or more valve members may be moveable through a range of positions between a first end position in which the first air outlet is maximally occluded and a second end position in which the second air outlet is maximally occluded. The one or more valve members may be moveable through a range of positions between a first end position in which the first air outlet is maximally occluded and the second air outlet is maximally open and a second end position in which the first air outlet is maximally open and the second air outlet is maximally occluded. Preferably, the one or more valve members are moveable relative to a body or outer casing of the nozzle. The valve may comprise a single valve member that is moveable to adjust the size of the first air outlet relative to the size (i.e. open area) of the second air outlet while keeping the size of the aggregate air outlet of the nozzle constant. Alternatively, the valve may comprise a plurality of valve members that cooperate to adjust the size of the first air outlet relative to the size of the second air outlet while keeping the size of the aggregate air outlet of the nozzle constant. To do so, the plurality of valve members may be linked so that they move simultaneously.

The first air outlet and the second air outlet may be provided on a face of the nozzle and oriented towards a central axis of the face of the nozzle. The convergent point may be located on a central axis of the face of the nozzle. The first and second air outlets may be diametrically opposed on the face of the nozzle.

Preferably, the nozzle comprises an external guide surface adjacent the air outlets. More preferably, the external guide surface extends between the first and second air outlets. Preferably, the external guide surface is outward facing, i.e. faces away from the centre of the nozzle. The external guide surface may span an area between (i.e. an area that separates) the first and second air outlets. In other words, the external guide surface may extend across the distance that separates the first and second air outlets. For example, the first and second air outlets may be diametrically opposed on the face of the nozzle, and the intermediate surface may then extend between the diametrically opposed first and second air outlets.

The nozzle may further comprise a nozzle body or outer casing that defines one or more outermost surface of the nozzle. The nozzle body or outer casing may then substantially define the external shape or form of the nozzle. The nozzle body or outer casing may define an opening at the face of the nozzle and the external guide surface may then be exposed within the opening. The face of the nozzle may therefore comprise the external guide surface. The external guide surface may therefore extend at least partially across the face the nozzle. The face of the nozzle may then further comprise a portion of the nozzle body that extends around or surrounds the periphery of the external guide surface (i.e. an edge of the opening within which the external guide surface is exposed).

The nozzle body may have the general shape of a truncated ellipsoid, with a first truncation defining a face of the nozzle body and a second truncation defining a base of the nozzle body. The air inlet may be provided at the base of the nozzle body. The first and second air outlets may be provided at the face of the nozzle body. The nozzle body may defines an opening at the face of the nozzle body, and the external guide surface may then be disposed within the opening. The first and second air outlets may be disposed around a periphery of the external guide surface. The air inlet may be at least partially defined by a first end of the air passageway. In particular, the air inlet may be at least partially defined by a first end of the air passageway that is disposed within a further opening provided at the base of the nozzle body. The first and second air outlets may be at least partially defined by an opposite, second end of the air passageway. In particular, the first and second air outlets may be at least partially defined by an opposite, second end of the air passageway that is disposed within the opening at the face of the nozzle body.

The first and second air outlets may be oriented to direct an air flow over at least a portion of the external guide surface. The first and second air outlets may be arranged to direct the air flow emitted therefrom such that the air flow passes across at least a portion of the external guide surface. The first and second air outlets may be arranged to direct an air flow over a portion of the external guide surface that is adjacent to the respective air outlet. Preferably, the external guide surface defines a portion of the first and second air outlets. The one or more valve members may comprise at least a portion of the external guide surface. The first outlet may be defined by a first portion of a body of the nozzle and a first portion of the external guide surface and the second outlet defined by a second portion of the body of the nozzle and a second portion of the external guide surface. The first portion of the external guide surface (i.e. that partially defines the first air outlet) may have a shape that corresponds with a shape of the opposing, first portion of the nozzle body. In particular, the first portion of the external guide surface may have a radius of curvature that is substantially equal to a radius of curvature of the opposing, first portion of the nozzle body. The second portion of the external guide surface (i.e. that partially defines the second air outlet) may have a shape that corresponds with a shape of the opposing, second portion of the nozzle body. In particular, the second portion of the external guide surface may have a radius of curvature that is substantially equal to a radius of curvature of the opposing, second portion of the nozzle body.

The nozzle may further comprise at least one air directing surface that is arranged to direct an air flow within the single internal air passageway towards the first and second air outlets.

The one or more valve members may be pivotally mounted. Preferably, the one or more valve members are arranged to pivot relative to a body of the nozzle, and optionally may also be arranged to pivot relative to the external guide surface. The one or more valve members may be pivotally mounted beneath, or adjacent to, the external guide surface.

The valve may comprise a single valve member that is arranged to pivot relative to a body of the nozzle, and that is optionally also arranged to pivot relative to the external guide surface. The valve member may be arranged to be pivotable between a first end position in which the first air outlet is maximally occluded and a second end position in which the second air outlet is maximally occluded. The valve member may be arranged to be pivotable between a first end position in which the first air outlet is maximally occluded and the second air outlet is maximally open and a second end position in which the first air outlet is maximally open and the second air outlet is maximally occluded. The valve member may comprise a first valve arm that is arranged to maximally occlude the first air outlet when the valve member is in the first end position and a second valve arm that is arranged to maximally occlude the second air outlet when the valve member is in the second end position. The valve member may comprise an air directing surface that is arranged to direct an airflow within the single air inlet passageway towards the first and second air outlets. The first valve arm and the second valve arm may then extend from opposing sides of the air directing surface and be continuous with the air directing surface.

The valve may comprise a first valve member and a second valve member that cooperate to adjust the size of the first air outlet relative to the size of the second air outlet while keeping the size of the aggregate air outlet of the nozzle constant. The first valve member and the second valve member may be linked so that they move simultaneously. The first valve member and the second valve member may each be arranged to be moveable between a first end position and a second end position, wherein in the first end position the first air outlet is maximally occluded by the first valve member and in the second end position the second air outlet is maximally occluded by the second valve member. The first valve member and the second valve member may each be arranged to be moveable between a first end position and a second end position, wherein in the first end position the first air outlet is maximally occluded by the first valve member and the second air outlet is maximally open and in the second end position the first air outlet is maximally open and the second air outlet is maximally occluded by the second valve member. The first valve member may be pivotally mounted adjacent to the first air outlet and the second valve member pivotally mounted adjacent to the second air outlet.

The first valve member may be linked to the second valve member by a coupler such that first valve member and the second valve member pivot simultaneously. The nozzle may further comprise a rod that is connected to any of the first valve member, the second valve member and the coupler such that movement of the rod causes simultaneous movement of the first valve member and second valve member. The rod may then extend out of the nozzle (i.e. out through the body/outer casing of the nozzle) with an external portion of the rod being arranged to provide a user operable handle and an internal portion of the rod being pivotally connected to any of the first valve member, second valve member and the coupler.

The first valve member may comprises a first valve arm that is arranged to maximally occlude the first air outlet when the first valve member is in the first end position and the second valve member comprise a second valve arm that is arranged to maximally occlude the second air outlet when the valve member is in the second end position. The first valve arm may extend from the first valve member into the first air outlet and the second valve arm may extend from the second valve member into the second air outlet. Each of the first valve member and the second valve member may comprise an air guiding surface that is arranged to guide an airflow within the single air inlet passageway towards the first and second air outlets respectively. The first valve arm may extend from and be continuous with the air guiding surface of the first valve member and the second valve arm extend from and be continuous with the air guiding surface of the second valve member.

The nozzle may further comprise an air directing surface disposed between the first valve member and the second valve member that is arranged to direct an airflow within the single air inlet passageway towards the first and second air outlets. The air directing surface may be disposed between the rearmost ends of the first valve member and the second valve member, is preferably convex or pointed, and is preferably arranged to be substantially continuous with the air guiding surfaces of the first and second valve members.

The one or more valve members may be arranged to move translationally (i.e. without rotation), and preferably rectilinearly (i.e. in a straight line). The one or more valve members may be arranged to move laterally relative to a body of the nozzle, and optionally may also be arranged to move laterally relative to the external guide surface.

The valve may comprise a single valve member that is arranged to be moveable between a first end position in which a first end of the valve member maximally occludes the first air outlet and a second end position in which a second end of the valve member maximally occludes the second air outlet.

The first and second air outlets may define a pair of elongate slots. The pair of elongate slots may form part of an annular nozzle. The annular nozzle may then comprise two long parallel sides, with a pair of elongate slots located in each of the sides. The annular nozzle may define a bore through which air from outside the nozzle is drawn by air emitted from the air outlets.

The valve member may be arranged to be pivotable between a first end position in which the elongate slot of the first air outlet is maximally occluded and a second end position in which the elongate slot of the second air outlet is maximally occluded. The valve member may be arranged to be pivotable between a first end position in which the elongate slot of the first air outlet is maximally occluded and the elongate slot of the second air outlet is maximally open and a second end position in which the elongate slot of the first air outlet is maximally open and the elongate slot of the second air outlet is maximally occluded. The first valve arm and the second valve arm may then extend from the valve member into the elongate slots of the first and second air outlets respectively.

The first and second air outlets may define a pair of arcuate slots. The nozzle may have an elliptical face, and the pair of arcuate slots may then be provided on the face of the nozzle and be diametrically opposed to one another. The pair of arcuate slots may form part of a generally cylindrical or ellipsoidal nozzle. The nozzle may define a generally elliptical opening, and the pair of arcuate slots may then be provided by separate portions of the opening. For example, the nozzle may define an opening or gap between the external guide surface and the nozzle body (i.e. an edge of the opening at the face of the nozzle body), and the one or more air outlets may then be provided by portions of the opening or gap. The portions of the opening between the pair of arcuate slots may each occluded by one or more covers. The one or more covers may be fixed. Alternatively, the one or more covers may be moveable between a closed position in which the portions of the opening between the pair of arcuate slots are occluded and an open position in which the portions of the opening between the pair of arcuate slots are open. For each of the portions of the gap/opening between the pair of arcuate slots, the corresponding cover may have a shape that corresponds with a shape of an opposing portion of the nozzle body. In particular, the corresponding cover may have a radius of curvature that is substantially equal to a radius of curvature of the opposing portion of the nozzle body.

The valve may comprise a single valve member that is arranged to be moveable between a first end position in which a first end of the valve member maximally occludes the arcuate slot of the first air outlet and a second end position in which a second end of the valve member maximally occludes the arcuate slot of the second air outlet. The first and second ends of the valve member may be arcuate in shape.

The valve may comprise a first valve member and a second valve member that are each arranged to be moveable between a first end position and a second end position, wherein in the first end position the arcuate slot of the first air outlet is maximally occluded by the first valve member and in the second end position the arcuate slot of the second air outlet is maximally occluded by the second valve member. A first valve arm may then extend from the first valve member into the arcuate slot of the first air outlet and a second valve arm extend from the second valve member into the arcuate slot of the second air outlet.

The nozzle may further comprise a base that is arranged to be connected to a fan assembly, and wherein the base defines the air inlet of the nozzle. Preferably, an angle of the face of the nozzle relative to the base of the nozzle is fixed. The angle of the face relative to the base may be from 0 to 90 degrees, is more preferably from 0 to 45 degrees, and is yet more preferably from 20 to 35 degrees.

The nozzle may further comprise control means for controlling the valve to selectively control the flow of air through the first and second air outlets.

The nozzle may be used in a wide variety of air delivery applications. For example, the nozzle can be incorporated into fans, purifiers, humidifiers, ceiling fans, AC units, HVAC units, and in-car air blowers.

According to a second aspect there is provided a nozzle for a fan assembly. The nozzle comprises an air inlet, a first air outlet for emitting an air flow and a second air outlet for emitting an air flow, the first and second air outlets being oriented in convergent directions and a valve for controlling the first and second air outlets. The valve comprises one or more valve members that are moveable to simultaneously adjust the size of the first air outlet and inversely adjust the size of the second air outlet. The one or more valve members are moveable through a range of positions between a first end position in which the first air outlet is maximally open and the second air outlet is maximally occluded and a second end position in which the first air outlet is maximally occluded and the second air outlet is maximally open.

According to a third aspect there is provided a fan assembly comprising an impeller, a motor for rotating the impeller to generate an air flow, and a nozzle according to any of the first aspect and the second aspect for receiving the air flow. The first air outlet and the second air outlet may be provided on a face of the nozzle. The fan assembly may further comprises a base upon which the fan assembly is supported, and an angle of the face of the nozzle relative to the base of the fan assembly may be fixed. The angle of the face of the nozzle relative to the base of the fan assembly may be from 0 to 90 degrees, is more preferably from 0 to 45 degrees, and is yet more preferably from 20 to 35 degrees. The base of the fan assembly is preferably provided at a first end of a body of the fan assembly, and the nozzle is then preferably mounted to an opposite second end of the body of the fan assembly. Preferably, the motor and the impeller are housed within the body of the fan assembly.

BRIEF DESCRIPTION OF THE FIGURES

An embodiment of the present invention will now be described, by way of example only, with reference to the accompanying drawings, in which.

DETAILED DESCRIPTION OF THE DISCLOSURE

Figure 2:
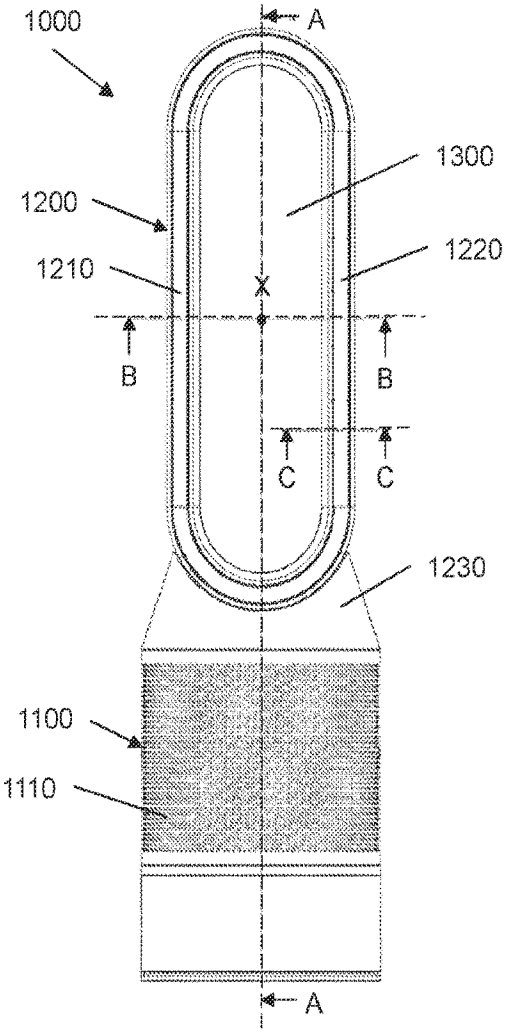
FIG. 2 is a front view of the fan assembly of FIG. 1.

There will now be described a nozzle for a fan assembly which is capable of receiving input of a single air flow, e.g. from a single air supply source, and manipulating the air flow such that the direction of the air flow emitted from the nozzle may be changed without the need to oscillate or tilt either the nozzle or the fan assembly to which the nozzle is attached. The term "fan assembly" as used herein refers to a fan assembly configured to generate and deliver an airflow for the purposes of thermal comfort and/or environmental or climate control. Such a fan assembly may be capable of generating one or more of a dehumidified airflow, a humidified airflow, a purified airflow, a filtered airflow, a cooled airflow, and a heated airflow.

The nozzle comprises an air inlet for receiving an airflow, a first air outlet for emitting an air flow and a second air outlet for emitting an air flow, with the first and second air outlets together defining an aggregate/combined air outlet of the nozzle, and with both the first and second air outlets being oriented towards a convergent point. A single internal air passageway extends between the air inlet and the first and second air outlets, and an air flow vectoring valve is provided within the single internal air passageway for controlling the air flow from the air inlet to the first and second air outlets. The air flow vectoring valve comprises one or more valve members that are moveable to adjust the size (i.e. the open area) of the first air outlet relative to the size of the second air outlet while keeping the overall size of the aggregate air outlet of the nozzle constant. In particular, the one or more valve members may be moveable through a range of positions between a first end position in which the first air outlet is maximally occluded (i.e. occluded to the maximum extent possible, such that the size of the first air outlet is at a minimum) and a second end position in which the second air outlet is maximally occluded. Conversely, in the first end position the second air outlet may be maximally open (i.e. open to the maximum extent possible, such that the size of the second air outlet is at a maximum) and in the second end position the first air outlet may be maximally open. The air flow vectoring valve is therefore preferably located adjacent to the first and second air outlets. In other words, the valve is arranged such that movement of the one or more valve members simultaneously adjusts the size of the first air outlet and inversely adjusts the size of the second air outlet whilst keeping the aggregate size of the first and second air outlets constant.

The term "air outlet" as used herein refers to a portion of the nozzle through which an air flow escapes from the nozzle. In particular, in the embodiments described herein, each air outlet comprises a conduit or duct that is defined by the nozzle and through which an air flow exits the nozzle. Each air outlet could therefore alternatively be referred to as an exhaust. This contrasts with other portions of the nozzle that are upstream from the air outlets and that serve to channel an air flow between an air inlet of the nozzle and an air outlet.

Through varying the size (i.e. the open area) of the first air outlet relative to the size of the second air outlet the proportion of the air flow that is emitted through each of the first and second air outlets also varies, thereby resulting in a change in the profile of the air flow generated by the nozzle. In particular, as the first and second air outlets are oriented towards a convergent point, the first and second air flows will collide at and/or around this point to form a single combined air flow that is directed away from the nozzle. The angle, or vector, at which the combined air flow is projected from the nozzle depends strongly on the relative strengths of the first and second air flows. Thus, by varying their individual strengths through moving the one or more valve members to adjust the size of the first air outlet relative to the second air outlet, it is possible to change the direction of the combined air flow. This arrangement means that the system sees constant load as the overall size of the aggregate air outlet remains constant. This means that the operating point of the compressor, or other means which supplies the air flow to the nozzle, also remains constant, as the air flow emitted from the nozzle can be controlled to vector back and forth. In addition, this allows for a reduction in the total system pressure that makes the system more energy efficient and quieter.

The first air outlet and the second air outlet may be provided on a face of the nozzle. The first air outlet and the second air outlet may then be oriented towards a central axis of the face of the nozzle such that the convergent point is located on a central axis of the face of the nozzle. Preferably, the first and second air outlets are diametrically opposed on the face of the nozzle. It is also preferable that the nozzle comprises an external guide surface adjacent the air outlets. This external guide surface comprises an external surface of the fan assembly such that it is outward facing (i.e. faces away from the centre of the nozzle) and may be flat or at least partially convex. The first and second air outlets can then each be oriented to direct an emitted air flow over at least a portion of this external guide surface, i.e. such that the air flow emitted therefrom passes across at least a portion of the external guide surface. Preferably, the first and second air outlets are oriented to emit an air flow in a direction that is substantially parallel to a portion of this external guide surface that is adjacent to the air outlet. It is then preferable that the external guide surface is shaped so that the external guide surface diverges or veers away from the direction in which the air flows are emitted from the first and second air outlets so that these air flows can collide at and/or around the convergent point without interference from the external guide surface. Emitting the air flows across the external guide surface minimises disruption of the air flows as they initially leave the nozzle, with the subsequent departure of the air flows from the external guide surface then allowing for the formation a separation bubble between the external guide surface, the emitted air flows and the convergent point. The formation of a separation bubble can assist in stabilising the resultant jet or combined air flow formed when the two opposing air flows collide.

It is also preferable that the external guide surface defines a portion of the first and second air outlets. In particular, the first outlet may defined by a first portion of a body or housing of the nozzle and a first portion of the external guide surface, and the second outlet may be defined by a second portion of the body/housing of the nozzle and a second portion of the external guide surface. The one or more valve members of the air flow vectoring valve will then be moveable relative to a body/housing of the nozzle and/or the external guide surface in order to adjust the size of the first air outlet relative to the size of second air outlet. In particular, the external guide surface may be fixed relative to the body/housing of the nozzle such that the one or more valve members will then be moveable relative to both the body/housing of the nozzle and the external guide surface in order to adjust the size of the first air outlet relative to the size of second air outlet. Alternatively, the one or more valve members may comprise the external guide surface such that the external guide surface will then be moveable relative to the nozzle body/housing so that the one or more valve members can adjust the size of the first air outlet relative to the size of second air outlet.

Figure 1:
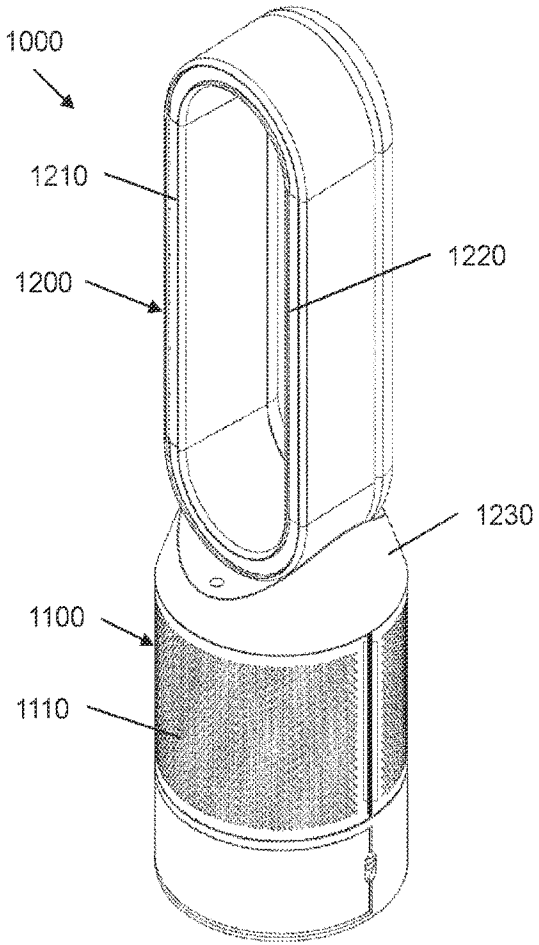
FIG. 1 is an isometric view of a first embodiment of a fan assembly.
Figure 3:
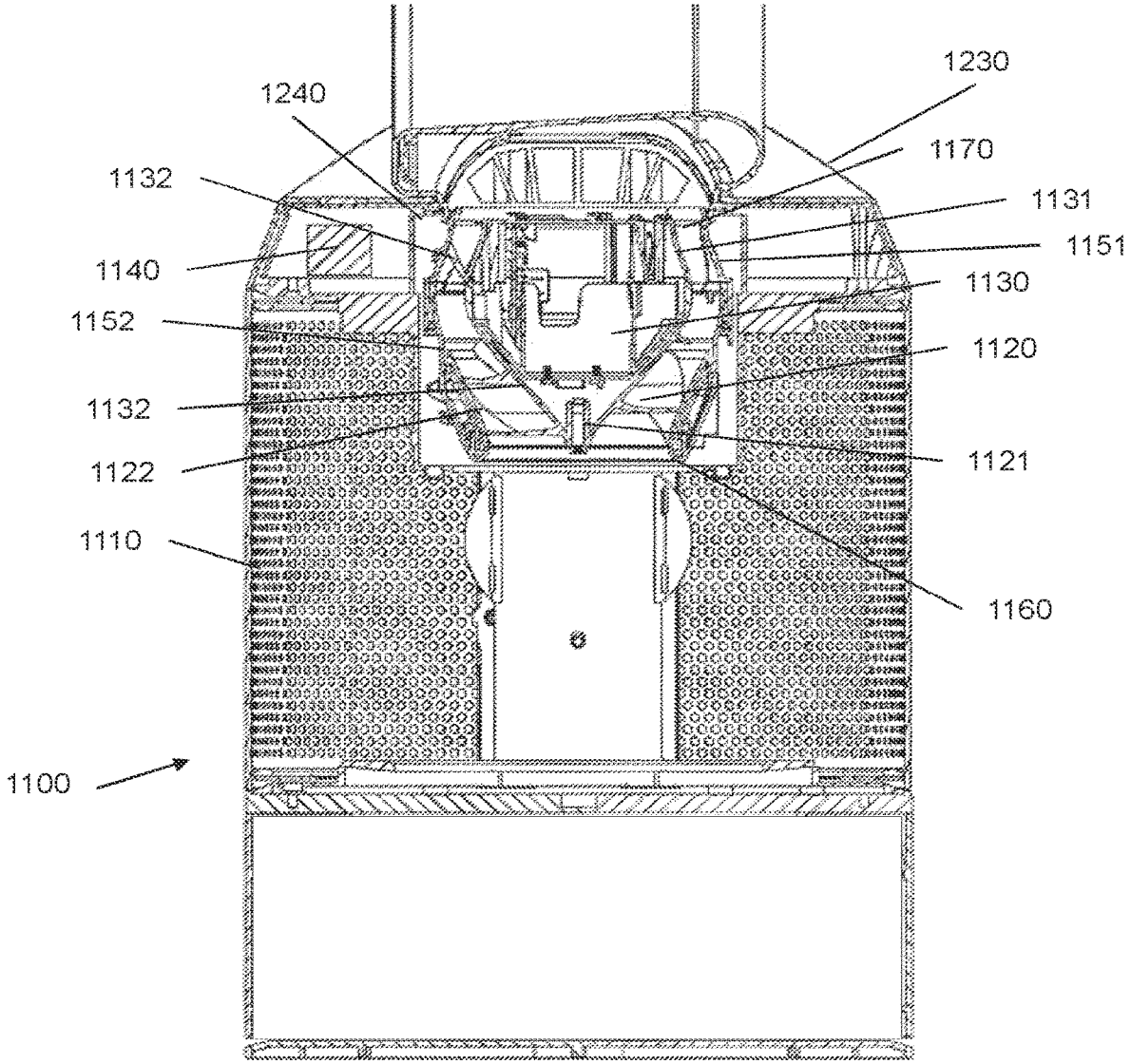
FIG. 3 is a sectional view take along line A-A of FIG. 2.
Figure 4:
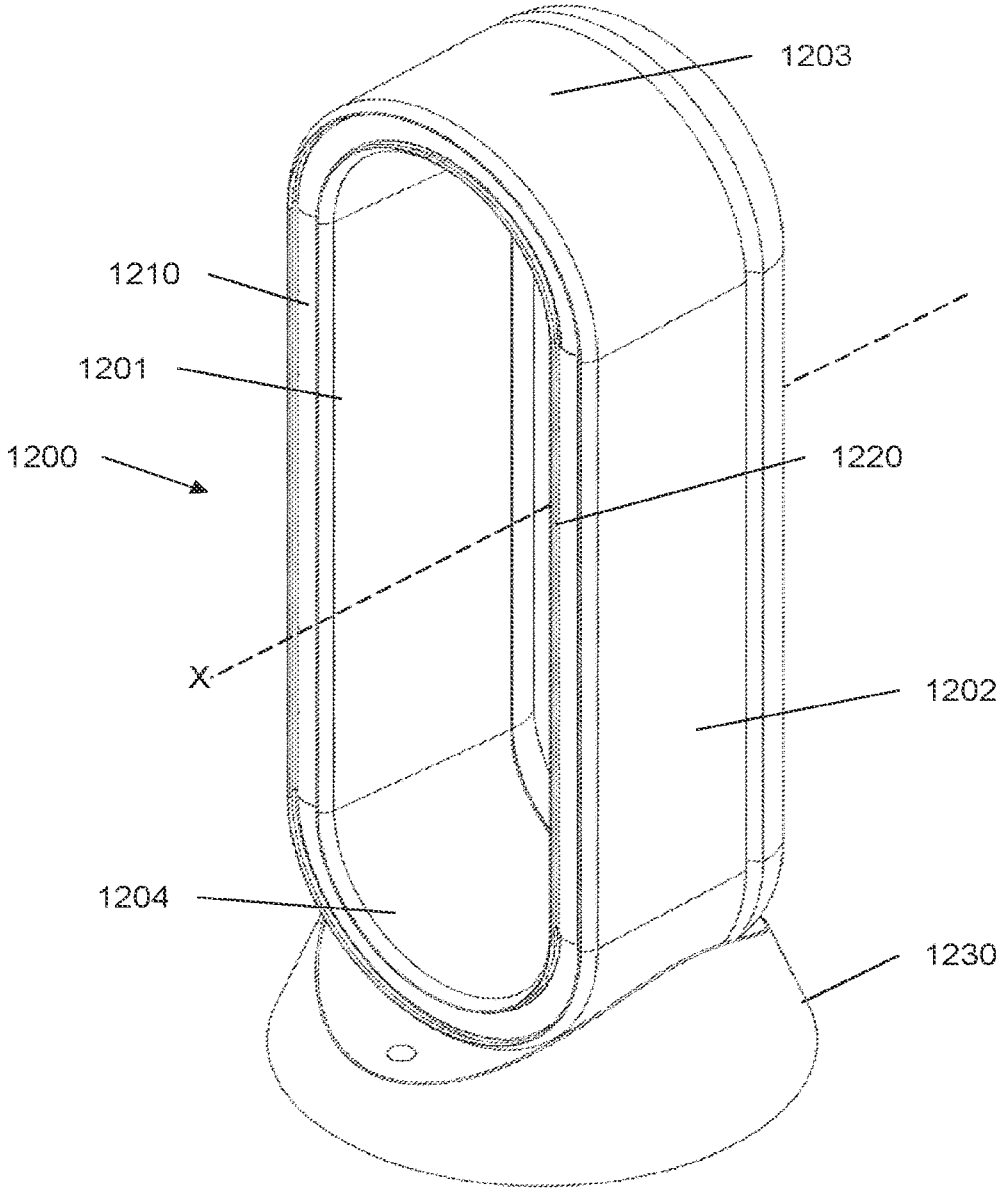
FIG. 4 is an isometric view of the annular nozzle of the fan assembly of FIG. 1.

FIGS. 1 and 2 are external views of a first embodiment of a fan assembly 1000. FIG. 1 shows an isometric view of the fan assembly 1000 and FIG. 2 is a front view of the fan assembly 1000. FIG. 3 then shows a sectional view through a body or stand 1100 of the fan assembly taken along lines A-A of FIG. 2, whilst FIG. 4 shows an isometric view of a nozzle 1200 of the fan assembly 1000.

The fan assembly 1000 comprises the body or stand 1100 and an elongate annular nozzle 1200 mounted on the body 1100. As will be described in more detail below, the annular nozzle 1200 then comprises two separate elongate nozzles 1210, 1220 for emitting air from the fan assembly 1000. In this embodiment, the body 1100 is substantially cylindrical and comprises an air inlet 1110 through which an airflow enters the body 1100 of the fan assembly 1000, and the air inlet 1110 comprises an array of apertures formed in the body 1100. Alternatively, the air inlet 1110 may comprise one or more grilles or meshes mounted within windows formed in the body 1100.

FIG. 3 illustrates a sectional view through the fan assembly 1000. The body 1100 houses the impeller 1120 for drawing the primary airflow through the air inlet 1110 and into the body 1100. Preferably, the impeller 1120 is in the form of a mixed flow impeller. The impeller 1120 is connected to a rotary shaft 1121 extending outwardly from a motor 1130. In the embodiment illustrated in FIG. 3, the motor 1130 is a DC brushless motor having a speed which is variable by a control circuit 1140 in response to control inputs provided by a user. The motor 1130 is housed within a motor housing that comprises an upper portion 1131 connected to a lower portion 1132. The upper portion 1131 of the motor housing further comprises an annular diffuser 1132 in the form of curved blades that project from the outer surface of the upper portion 1131 of the motor housing.

The motor housing 1131, 1132 is mounted within a duct that is mounted within the body 1100. The duct comprises a generally frusto-conical upper wall 1151, a generally frusto-conical lower wall 1152 and an impeller shroud 1122 located within and abutting against the lower wall 1152. A substantially annular inlet member 1160 is then connected to the bottom of the duct for guiding the primary airflow into the impeller housing. An air inlet of the duct is therefore defined by the annular inlet member 1160 provided at the bottom end of the duct. An air vent/opening 1170, through which the primary airflow is exhausted from the body 1100, is then defined by the upper portion 1131 of the motor housing and the upper wall 1151 of the duct. A flexible sealing member (not shown) is attached between the upper wall 1151 of the duct and the body 1110 to prevent air from passing around the outer surface of the duct to the inlet member 1160. The sealing member preferably comprises an annular lip seal, preferably formed from rubber.

The nozzle 1200 is mounted on the upper end of the body 1110 over the air vent 1170 through which the primary airflow exits the body 1100. The nozzle 1200 comprises a neck/base 1230 that connects to upper end of the body 1100 and has an open lower end which provides an air inlet 1240 for receiving the primary airflow from the body 1100. The external surface of the base 1230 of the nozzle 1200 is then substantially flush with the outer edge of the body 1100. The base 1230 therefore comprises a housing that covers/encloses any components of the fan assembly 1000 that are provided on an upper surface of the body 1100, which in this embodiment includes the control circuit 1140.

In the embodiment illustrated in FIG. 4, the nozzle 1200 has an elongate annular shape, often referred to as a stadium or discorectangle shape, and defines a correspondingly shaped opening or bore 1300 having a height (as measured in a direction extending from the upper end of the nozzle to the lower end of the nozzle 1200) greater than its width (as measured in a direction extending between the side walls of the nozzle 1200), and a central axis (X). The nozzle 1200 therefore comprises two parallel, straight sections 1201, 1202 each adjacent a respective elongate side of the opening 1300, an upper curved section 1203 joining the upper ends of the straight sections 1201, 1202, and a lower curved section 1204 joining the lower ends of the straight sections 1201, 1202.

Figure 5:
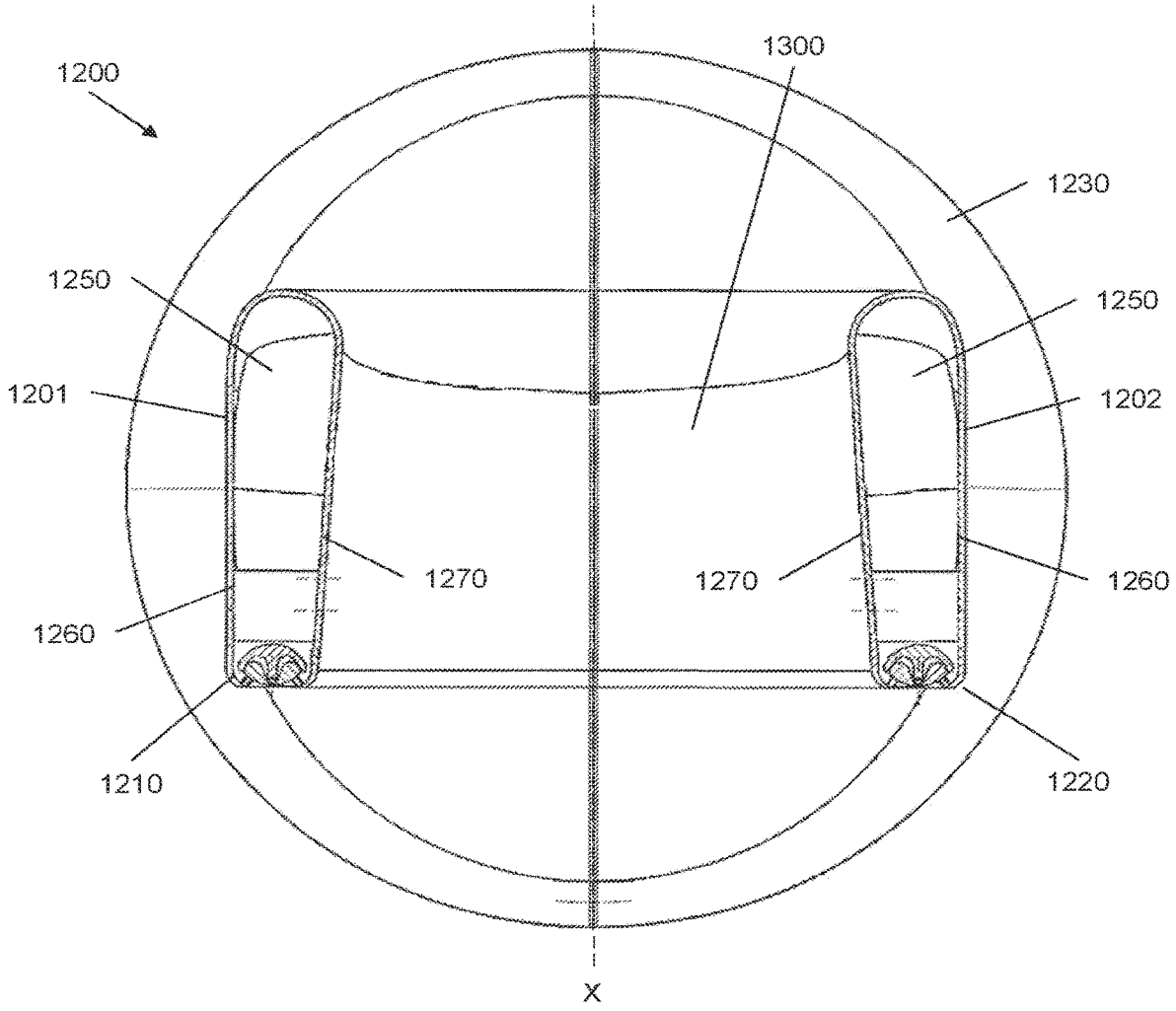
FIG. 5 is a horizontal cross-sectional view of the annular nozzle taken along line B-B of FIG. 2.
Figure 6:
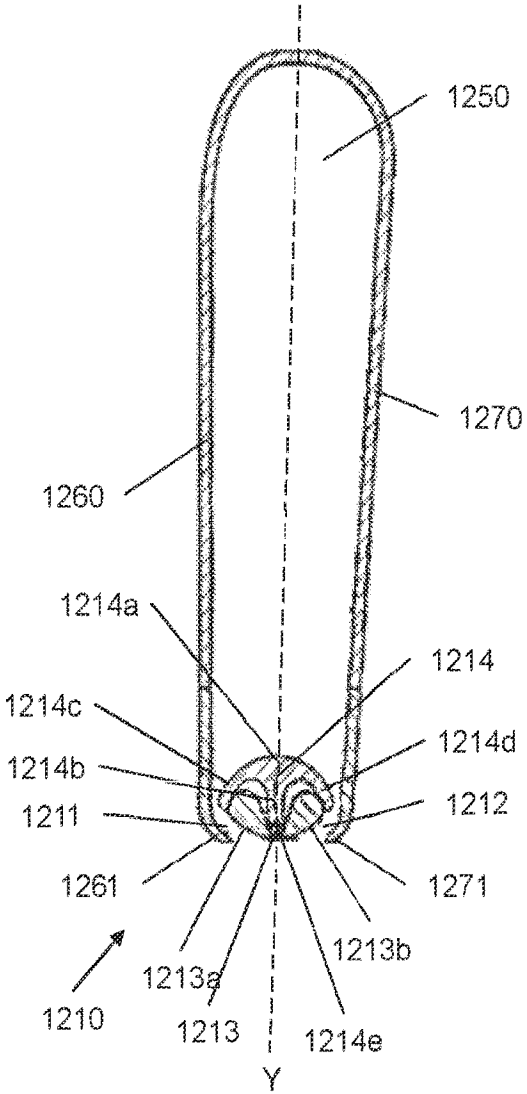
FIG. 6 is a simplified horizontal cross-sectional view of the annular nozzle taken along line C-C of FIG. 2.

Each one of the parallel side sections 1201, 1202 forms a separate elongate, linear nozzle 1210, 1220. The linear nozzles 1210, 1220 extend substantially along the whole length of the side sections 1201, 1202. As shown in FIGS. 5 and 6, each linear nozzle 1210, 1220 comprises a first air outlet 1211 and a second air outlet 1212. The first air outlet 1211 and the second air outlet 1212 are located on opposing sides of a fixed guide surface 1213, and are orientated to direct an air flow over a portion of the guide surface 1213 that is adjacent to the respective air outlet. The construction and operation of the linear nozzles 1210, 1220 will be described in more detail below in relation to FIGS. 5 to 7.

The air inlet 1240 of the elongate annular nozzle 1200 is arranged to receive an air flow from the air vent/opening 1170 through which the primary airflow is exhausted from the body 1100. A single internal air passageway 1250 extends around the elongate annular nozzle 1200 and receives the air from the air inlet 1240. When air flows from the air vent/opening 1170 into the air inlet 1240 of the elongate annular nozzle 1200 it is split in two and flows in opposite angular directions about the bore 1300 of the elongate annular nozzle 1200 through the internal air passageway 1250.

The upper and lower curved section 1203, 1204 of the elongate annular nozzle 1200 are blocked so that no air flow can exit the elongate annular nozzle 1200 through the curved sections 1203, 1204. Rather, the air flow is permitted to exit the elongate annular nozzle 1200 through the linear nozzles 1210, 1220 which extend along the parallel side sections 1201, 1202 of the elongate annular nozzle 1200. Air guide vanes (not shown) are provided on an inner surface of the parallel side sections 1201, 1202 to turn the vertically oriented air flow through 90° towards the linear nozzles 1210, 1220 which are provided on a forward facing surface of the elongate annular nozzle 1200.

Turning now to FIG. 6, this shows a horizontal cross-sectional view of the elongate annular nozzle 1200 taken along line C-C of FIG. 2. The construction and operation of the linear nozzles 1210, 1220 are the same, so for the sake of clarity reference will be made only to one of the linear nozzles 1210. It will be understood that the description also applies to the other of the linear nozzles 1220. The linear nozzles 1210, 1220 may be independently controlled such that the direction of the air flow emitted from each of the parallel side sections 1201, 1202 can be controlled independently. This enables the elongate annular nozzle 1200 to generate a number of different flow patterns, which will be described in more detail below.

In this embodiment, the body of the elongate annular nozzle 1200 is partially defined by an outer wall 1260 of the elongate annular nozzle 1200 and an inner wall 1270 of the elongate annular nozzle 1200. An outer surface of the inner wall 1270 surrounds the bore axis (X) and defines the bore 1300. The outer wall 1260 and inner wall 1270 also define the internal air passageway 1250. At a front end of the elongate annular nozzle 1200 the outer wall 1260 and inner wall 1270 are turned inwardly towards the central axis (Y) of the linear nozzle 1210. The inwardly turned portions 1261, 1271 of the outer and inner walls 1260, 1270 define, in part, the first air outlet 1211 and the second air outlet 1212 of the linear nozzle 1210.

The guide surface 1213 is located between inwardly turned portions 1261, 1271 of the outer and inner walls 1260, 1270. A first portion 1213*a* of the guide surface 1213 and the inwardly turned portion 1261 of the outer wall 1260 therefore together define an elongate, linear slot that forms the first air outlet 1211, whilst a second portion 1213*b* of the guide surface 1213 and the inwardly turned portion 1271 of the inner wall 1270 together define a further elongate, linear slot that forms the second air outlet 1212. These first and second air outlets 1211, 1212 are the same size and together form an aggregate or combined air outlet of the linear nozzle 1210.

In this embodiment the guide surface 1213 is fixed relative to the body of the elongate annular nozzle 1200 that is partially defined by the outer wall 1260 and the inner wall 1270. The guide surface 1213 is convex, with the outermost points of the outer wall 1260 and inner wall 1270 being offset relative to the outermost point of the guide surface 1213. In particular, the outermost point of the outer wall 1260 and inner wall 1270 are in front of the outermost point of the guide surface 1213.

Mounted behind the guide surface 1213 is a valve member 1214. The valve member 1214 is pivotally mounted directly behind the central axis (Y) of the guide surface 1213 and is symmetrical about a central axis of the valve member 1214. The valve member 1214 can generally be described as "anchor-shaped", and comprises a valve member body having a convex rear air directing surface 1214*a*, a central vertical hinge arm 1214*b* that extends from the front surface of the valve member body, and a pair of opposing valve arms 1214*c*, 1214*d* that extend toward the first and second air outlets 1211, 1212 respectively. The directing surface 1214*a* is arranged to direct or deflect an airflow within the single internal air passageway 1250 towards the first and second air outlets 1211, 1212. The first and second valve arms 1214*c*, 1214*d* then extend from opposing sides of the directing surface 1214*a* and are continuous with the directing surface 1214*a*.

In use the valve member 1214 can pivot in a first direction such that the first valve arm 1214*c* moves into and closes off/occludes the first air outlet 1211, and it can pivot in a second direction, opposite to the first direction, such that the second valve arm 1214*d* moves into and closes off/occludes the second air outlet 1212. The valve member 1214 is therefore arranged such that the first valve arm 1214*c* maximally occludes the first air outlet 1211 (i.e. is occluded to the maximum extent possible, such that the size of the first air outlet 1211 is at a minimum) when the valve member 1214 is in a first end position and such that the second valve arm 1214*d* maximally occludes the second air outlet 1212 when the valve member 1214 is in a second end position. Conversely, when the valve member 1214 is in the first end position the second air outlet 1212 is maximally open (i.e. open to the maximum extent possible, such that the size of the second air outlet is at a maximum) and when the valve member 1214 is in a second end position the first air outlet 1211 is maximally open. When the valve member 1214 pivots between its two extreme positions the size/open area of the aggregate/combined air outlet remains constant.

The first air outlet 1211 and the second air outlet 1212 are each arranged to direct an emitted air flow towards a convergent point that is aligned with a central axis (Y) of the guide surface 1213. The first air outlet 1211, the second air outlet 1212 and the guide surface 1213 are then arranged such that emitted air flows are directed over a portion of the guide surface 1213 that is adjacent to the respective air outlet. In particular, the air outlets 1211, 1212 are arranged to emit an air flow in a direction that is substantially parallel to the portion of the guide surface 1213 adjacent the air outlet 1211, 1212. The convex shape of the guide surface 1213 then provides that the air flows emitted from the first and second air outlets 1211, 1212 will depart from the guide surface 1213 as they approach the convergent point so that these air flows can collide at and/or around the convergent point without interference from the guide surface 1213. When the emitted air flows collide, a separation bubble is formed that can assist in stabilising the resultant jet or combined air flow formed when two opposing air flows collide.

A stepper motor (not shown) is connected to the valve member 1214 and can be actuated to cause rotation of the valve member 1214 about its pivot point 1214*e*. As will be described in more detail with reference to FIGS. 8*a* to 8*c*, it is possible to control the direction of the air flow emitted from the elongate annular nozzle 1200 by varying the relative amounts of air flow emitted from each of the air outlets 1211, 1212 of each of the linear nozzles 1210, 1220. With the valve member 1214 in a central position, as it is in FIGS. 6 and 7, the size of the first and second air outlets 1211, 1212 is the same and, consequently, the same amount of air flow is emitted from each outlet 1211, 1212. The air flows will collide in front of the guide surface 1213 and as they have the same magnitude the resultant airflow will be directed in a forward direction. By varying the relative sizes (i.e. open area) of the first and second air outlets 1211, 1212 it is possible to achieve a wide variety of different flow behaviours without to the need to oscillate or tilt the fan assembly.

Figure 7:
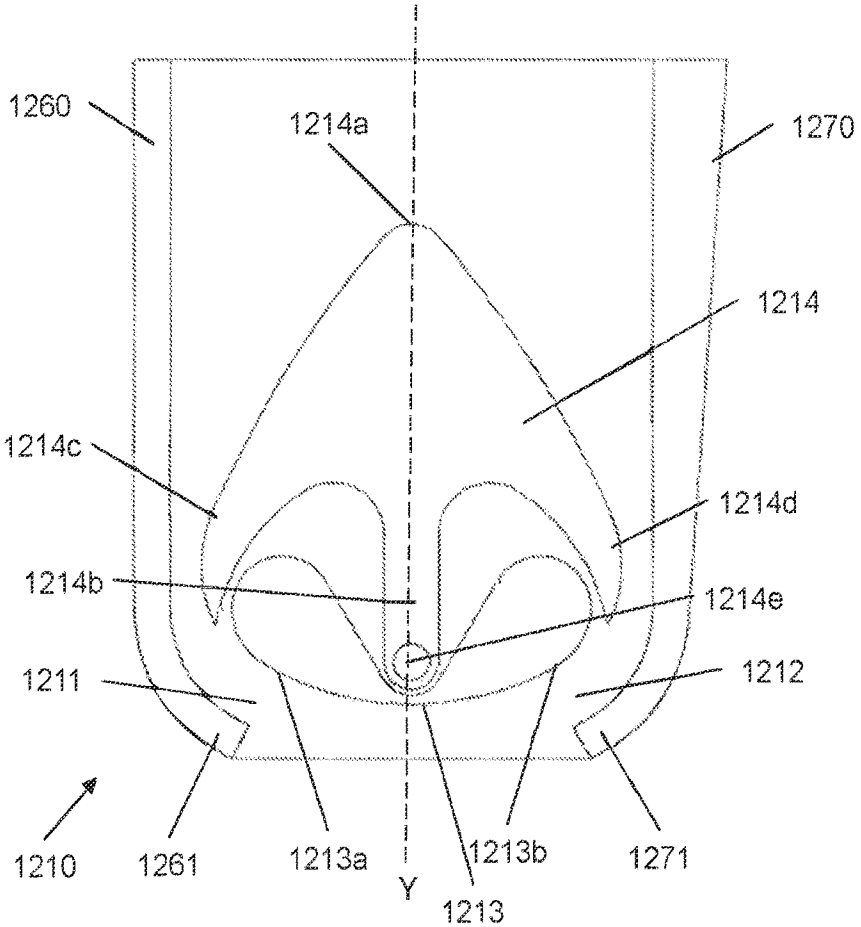
FIG. 7 is a simplified horizontal cross-sectional view an alternative embodiment of a flow vectoring valve for the annular nozzle of the fan assembly of FIG. 1.

FIG. 7 shows an alternative embodiment of a valve for controlling the air flow from the air inlet to the first and second air outlets 1211, 1212. In this embodiment, rather than having a smooth convex rear air directing surface, the rear air directing surface 1214*a* of the valve member 1214 has a more pointed shape that directs or deflects an airflow within the single internal air passageway 1250 towards the first and second air outlets 1211, 1212. In particular, in this embodiment, the body of the valve member 1214 has a substantially triangular cross-section with the central vertical hinge arm 1214*b* extending from a front edge of the body. The air directing surface 1214*a* is then defined by the two rearmost edges of the body that converge to a smooth point or apex. The first valve arm 1214*c* extends from and is continuous with a first of the two rearmost edges and the second valve arm 1214*d* extends from and is continuous with a second of the two rearmost edges.

Figure 8A:
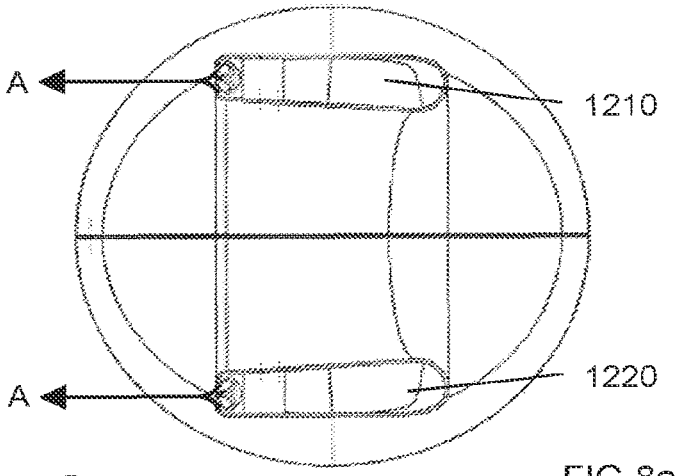
FIG. 8*a* is a simplified horizontal cross-sectional view of the annular nozzle illustrating a valve member in a first position.
Figure 8B:
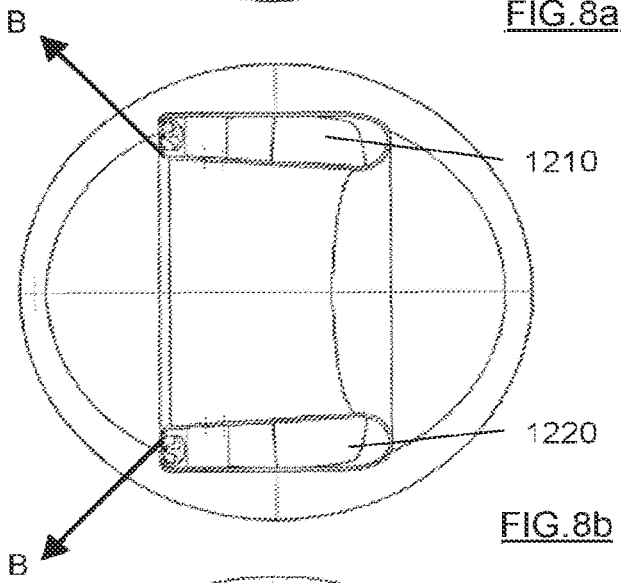
FIG. 8*b* is a simplified horizontal cross-sectional view of the annular nozzle illustrating a valve member in a second position.
Figure 8C:
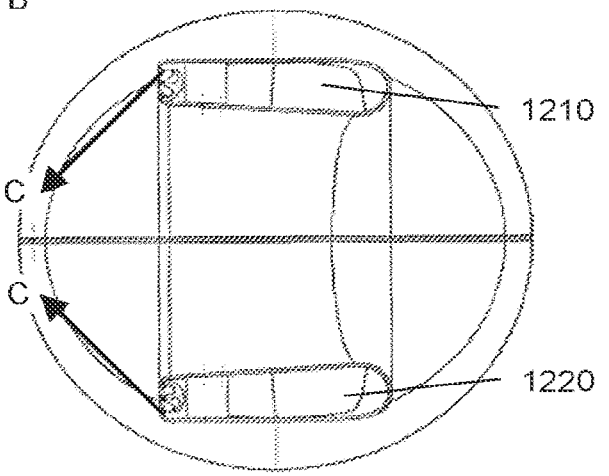
FIG. 8*c* is a simplified horizontal cross-sectional view of the annular nozzle illustrating a valve member in a third position.

Turning now to FIGS. 8*a* to 8*c*, these show three potential air flow combinations that can be achieved by varying the size (i.e. the open area) of the first air outlet 1211 relative to the size of the second air outlet 1212 of each of the linear nozzles 1210, 1220. In practice, by varying the relative size of the first and second air outlets 1211, 1212 and/or by controlling each of the linear nozzles 1210, 1220 independently, a wide range of possible air flow combinations and behaviours may be achieved.

In FIG. 8*a* each of the linear nozzles 1210, 1220 is arranged with its valve member 1214 in a central position such that equal amounts of air are directed to flow from each of the first and second air outlets 1211, 1212. This means that the resultant air flow generated by each of the linear nozzles 1210, 1220, and therefore the fan assembly 1000 as a whole, is directed in a generally forward direction, as indicated by arrows A.

In FIG. 8*b* each of the linear nozzles 1210, 1220 is arranged to direct the air flow outwardly relative to the axis of the bore 1300 thereby resulting in a diffuse overall air flow. This is flow is particularly advantageous for room heating. In the first linear nozzle 1210 the valve member 1214 has been rotated to maximally occlude the first air outlet 1211. This means that most, if not all, of the air flow entering the first linear nozzle 1210 will be emitted through the second air outlet 1212. The air flow will be directed to flow over the guide surface 1213 as normal, but since it will not collide with any significant air flow that is emitted from the first air outlet 1211 it will continue on its flow path outwardly relative to the axis of the bore 1300. In the second linear nozzle 1220, the valve member 1214 has also been rotated to maximally occlude the first air outlet 1211, such that most, if not all, of the air flow entering the second linear nozzle 1220 will be emitted through the second air outlet 1212. As with the first linear nozzle 1210, the air flow will be directed to flow over the guide surface 1213 as normal, but since it will not collide with any significant air flow that is emitted from the first air outlet 1211 it will continue on its flow path outwardly relative to the axis of the bore 1300. The air flow from both the first and second linear nozzles 1210, 1220 being directed outwardly results in a diffuse overall air flow from the fan assembly, as indicated by arrows B.

In FIG. 8*c* each of the linear nozzles 1210, 1220 is arranged to direct the air flow inwardly relative to the axis of the bore 1300 in a focused air flow. This is flow is particularly advantageous for personal heating. In the first linear nozzle 1210 the valve member 1214 has been rotated to maximally occlude the second air outlet 1212. This means that most, if not all, of the air flow entering the first linear nozzle 1210 will be emitted through the first air outlet 1211. The air flow will be directed to flow over the guide surface 1213 as normal, but since it will not collide with any significant air flow that is emitted from the second air outlet 1212 it will continue on its flow path inwardly towards the axis of the bore 1300. In the second linear nozzle 1220 the valve member 1214 has also been rotated to maximally occlude the second air outlet 1212. This again means that most, if not all, of the air flow entering the second linear nozzle 1220 will be emitted through the first air outlet 1211. The air flow will be directed to flow over the guide surface 1213 as normal, but since it will not collide with any significant air flow that is emitted from the second air outlet 1212 it will continue on its flow path inwardly towards the axis of the bore 1300. The air flow from both the first and second linear nozzles 1210, 1220 being directed inwardly results in a focused air flow as indicated by arrows C.

It will be readily understood that the examples of FIGS. 8*a*, 8*b* and 8*c* are merely representative, and actually represent some of the extreme cases. By utilising the control circuit 1140 to control the stepper motors connected to the valve members 1214 within each of the first and second linear nozzles 1210, 1220 it is possible to achieve a wide variety of resultant air flows. A particularly advantageous behaviour is to control the stepper motors for each of the linear nozzles 1210, 1220 to create the effect of an oscillating air flow without the need to physically move the fan assembly. This effect is achieved by starting with the first linear nozzle 1210 directed inwardly towards the axis of the bore 1300 and the second linear nozzle 1220 directed outwardly away from the axis of the bore 1300. Then by controlling the stepper motors in unison it is possible to gradually adjust the linear nozzles 1210, 1220 so that airflow generated by the first linear nozzle 1210 gradually sweeps from being outwardly directed to inwardly directed, while the second linear nozzle 1220 gradually sweeps from being inwardly directed to outwardly directed. The effect of this is that the overall air flow generated by the fan assembly 1000 changes from being projected forwards and to the left, to being projected forwards and to the right. The process can then be reversed to return to the original position. In going through this cycle an oscillation effect is achieved without the need to physically oscillate the fan assembly 1000. It will be appreciated that a wide variety of possible fan behaviours can be achieved using this method.

It will also be appreciated that in the fan assembly 100 illustrated in FIGS. 1 to 8*c*, the emission of the air flow from the linear nozzles 1210, 1220 causes a secondary air flow to be generated by the entrainment of air from the external environment. Specifically, air from the external environment is drawn through the bore 1300 and around the sides of the elongate annular nozzle 1200. This secondary air flow combines with the primary air flow emitted from the elongate annular nozzle 1200 to produce a combined, or total, air flow, or air current, projected forward from the fan assembly 1000.

Figure 10:
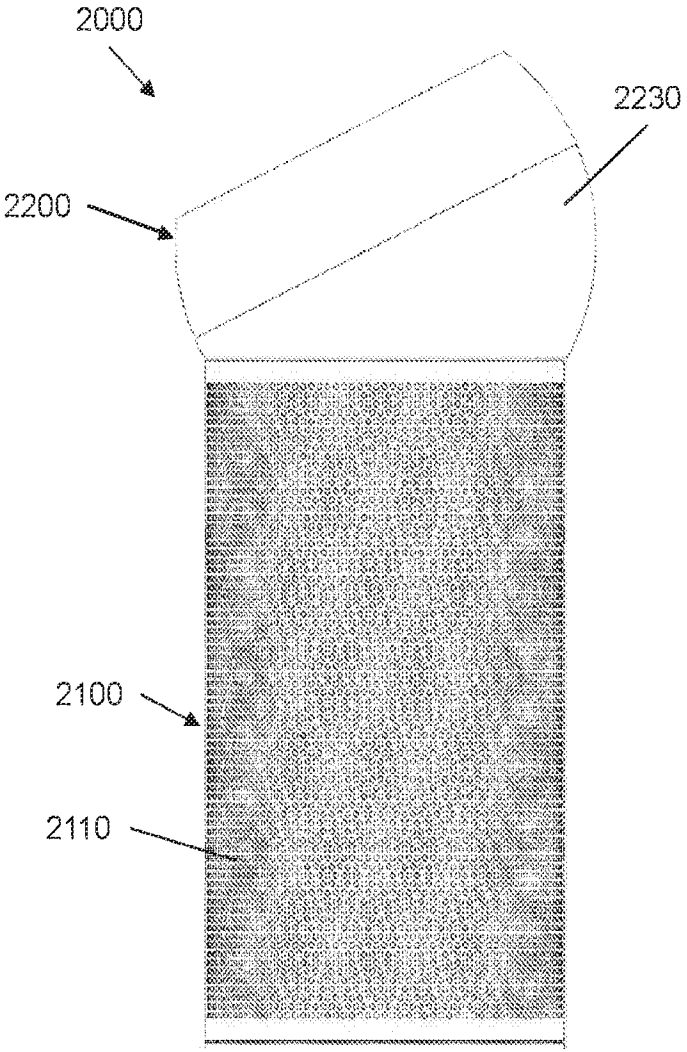
FIG. 10 is a side view of the fan assembly of FIG. 9.
Figure 9:
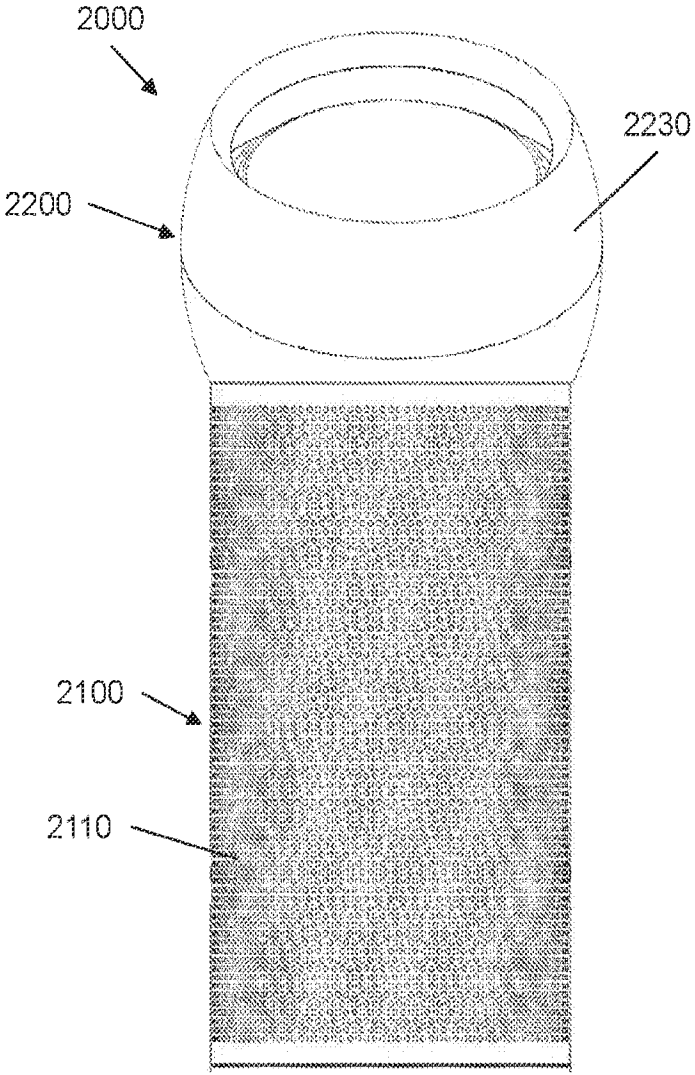
FIG. 9 is a front view of a second embodiment of a fan assembly.

FIGS. 9 and 10 then show a second embodiment of a fan assembly 2000 according to the present invention. As can clearly be seen in FIGS. 9 and 10, a key difference between the fan assemblies 1000, 2000 is that in the second embodiment the fan assembly 200 does not have an elongate annular nozzle which surrounds a bore. Although the fan assemblies 1000, 2000 look quite different the bodies 1100, 2100 of the fan assemblies are essentially the same. For this reason the description of the body 2100 will not be repeated.

The nozzle 2200 is mounted on the upper end of the body 2110 over the air vent through which the primary airflow exits the body 2100. The nozzle 2200 has an open lower end which provides an air inlet 2240 for receiving the primary airflow from the body 2100. The external surface of an outer wall of the nozzle 2200 then converges with the outer edge of the body 2100.

The nozzle 2200 comprises a nozzle body, outer casing or housing 2230 that defines the outermost surfaces of the nozzle and therefore defines the external shape or form of the nozzle 2200. In the illustrated embodiment, the nozzle body/outer casing 2230 of the nozzle 2200 has the general shape of a truncated sphere, with a first truncation forming a circular face 2231 of the nozzle and a second truncation forming a circular base 2232 of the nozzle body 2230, and the angle ($\alpha$) of the face 2231 of the nozzle body 2230 relative to the base 2232 of the nozzle body 2230 is fixed. In the illustrated embodiment, this angle ($\alpha$) is approximately 25 degrees; however, the angle of the face 2231 relative to the base 2232 of the nozzle body 2230 could be anything from 0 to 90 degrees, is more preferably from 0 to 45 degrees, and is yet more preferably from 20 to 35 degrees.

In the illustrated embodiment, the first truncation provides that the diameter (DN) of the nozzle body 2230 is approximately 1.2 times greater than the diameter (DF) of the circular face 2231 of the nozzle body 2230; however, the diameter (DN) of the nozzle body 2230 could be anything from 1.05 to 2 times greater than a diameter (DF) of the circular face 2231 of the nozzle body, and is preferably from 1.1 to 1.4 times greater. The second truncation then provides that diameter (DN) of the nozzle body 2230 is also approximately 1.2 times greater than the diameter (DB) of the circular base 2232 of the nozzle body 2230; however, the diameter (DN) of the nozzle body 2230 could be anything from 1.05 to 2 times greater than the diameter (DB) of the circular base 2232 of the nozzle body 2230, and is preferably from 1.1 to 1.4 times greater.

The nozzle body 2230 defines an opening at the circular face 2231 of the nozzle body 2230. The nozzle 2200 then further comprises a fixed, external guide surface 2250 that is located concentrically within the opening at the circular face 2231 of the nozzle body 2230 such that this external guide surface 2250 is at least partially exposed within the opening, with a portion of the nozzle body 2230 extending around the periphery of the guide surface 2250. The external guide surface 2250 is therefore outward facing (i.e. faces away from the centre of the nozzle).

In the illustrated embodiment, this guide surface 2250 is convex and substantially disk-shaped; however, in alternative embodiments the guide surface 2250 could be flat or only partially convex. An inwardly curved upper portion 2230*a* of the nozzle body 2230 then overlaps/overhangs a circumferential portion 2250*a* of the guide surface 2250. The outermost, central portion 2250*b* of the convex guide surface is then offset relative to the outermost point of the open circular face 2231 of the nozzle body 2230. In particular, the outermost point of the open circular face 2231 of the nozzle body 2230 is in front of the outermost portion 2250*b* of the guide surface.

The circumferential portion 2250*a* of the guide surface 2250 and an opposing portion of the nozzle body 2230 together define a generally annular gap 2260 between them, with two diametrically opposed portions of this gap 2260 then forming a pair of congruent, circular arc shaped slots that provide the first and second air outlets 2210, 2220 of the nozzle 2200. The guide surface 2250 therefore provides an intermediate surface that spans the area between the first and second air outlets 2210, 2220. In other words, the guide surface 2250 forms an intermediate surface that extends across the space that separates the first and second air outlets 2210, 2220. As will be described in more detail below, in at least one configuration of the nozzle 2200, the portions of the gap 2260 that separate the pair of arcuate slots are then covered/occluded.

In the illustrated embodiment, the pair of arcuate slots that provide the first and second air outlets 2210, 2220 each have an arc angle (β) (i.e. the angle subtended by the arc at the centre of the circular face 2231) of approximately 60 degrees; however, they could each have an arc angle of anything from 20 to 110 degrees, preferably from 45 to 90 degrees, and more preferably from 60 to 80 degrees. Consequently, the area of the gap 2260 can be anything from 3 to 18 times greater than the area of each of the first and second air outlets 2210, 2220, is preferably from 4 to 8 times greater, and is more preferably from 4 to 6 times greater.

The first and second air outlets 2210, 2220 are approximately the same size and together form an aggregate or combined air outlet of the spherical nozzle 2200. The first air outlet 2210 and the second air outlet 2220 are located on opposing sides of the guide surface 2250, and are orientated to direct an emitted air flow over a portion of the guide surface 2250 that is adjacent to the respective air outlet and towards a convergent point that is aligned with a central axis (YY) of the guide surface 2250. The first air outlet 2210, the second air outlet 2220 and the guide surface 2250 are then arranged such that emitted air flows are directed over a portion of the guide surface 2250 that is adjacent to the respective air outlet. In particular, the air outlets 2210, 2220 are arranged to emit an air flow in a direction that is substantially parallel to the portion of the guide surface 2250 adjacent the air outlet 2210, 2220. The convex shape of the guide surface 2250 then provides that the air flows emitted from the first and second air outlets 2210, 2220 will depart from the guide surface 2250 as they approach the convergent point so that these air flows can collide at and/or around the convergent point without interference from the guide surface 2250. When the emitted air flows collide, a separation bubble is formed that can assist in stabilising the resultant jet or combined air flow formed when two opposing air flows collide.

Figure 11:
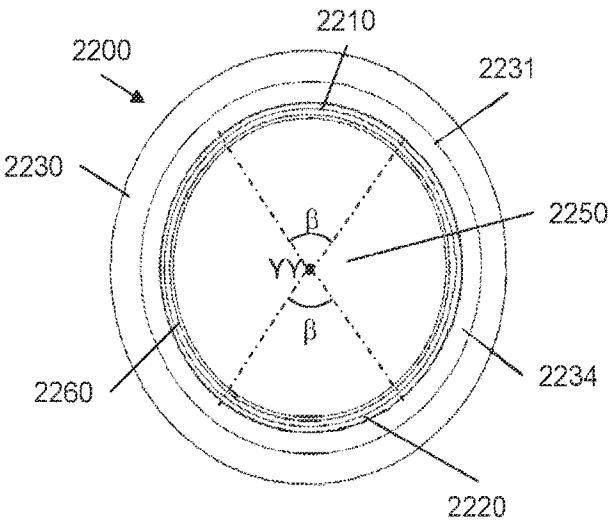
FIG. 11 is an isometric view of the spherical nozzle of the fan assembly FIGS. 9 and 10.
Figure 12:
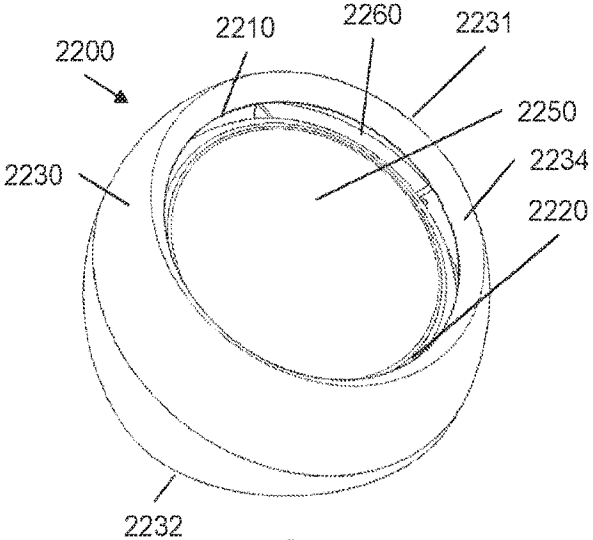
FIG. 12 is a top view of the spherical nozzle of the fan assembly FIGS. 9 and 10.
Figure 13:
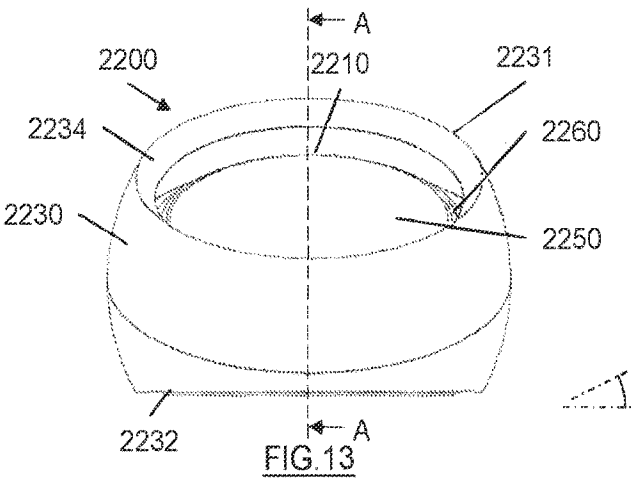
FIG. 13 is a front view of the spherical nozzle of the fan assembly FIGS. 9 and 10.
Figure 14:
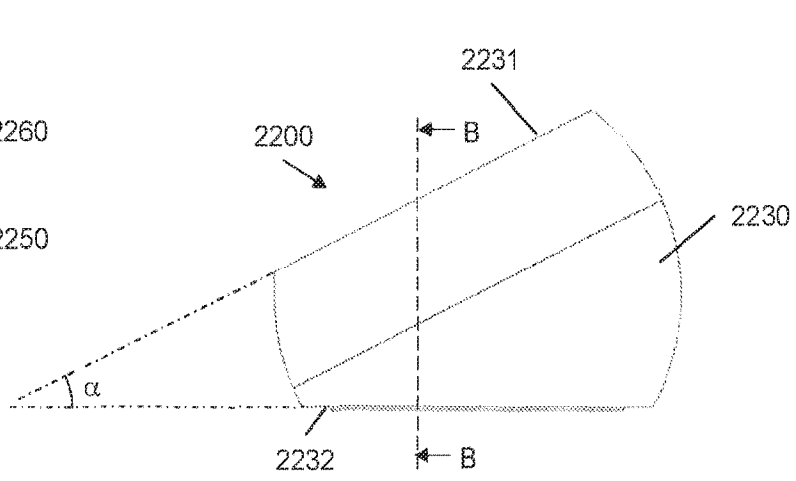
FIG. 14 is a side view of the spherical nozzle of the fan assembly FIGS. 9 and 10.
Figure 15:
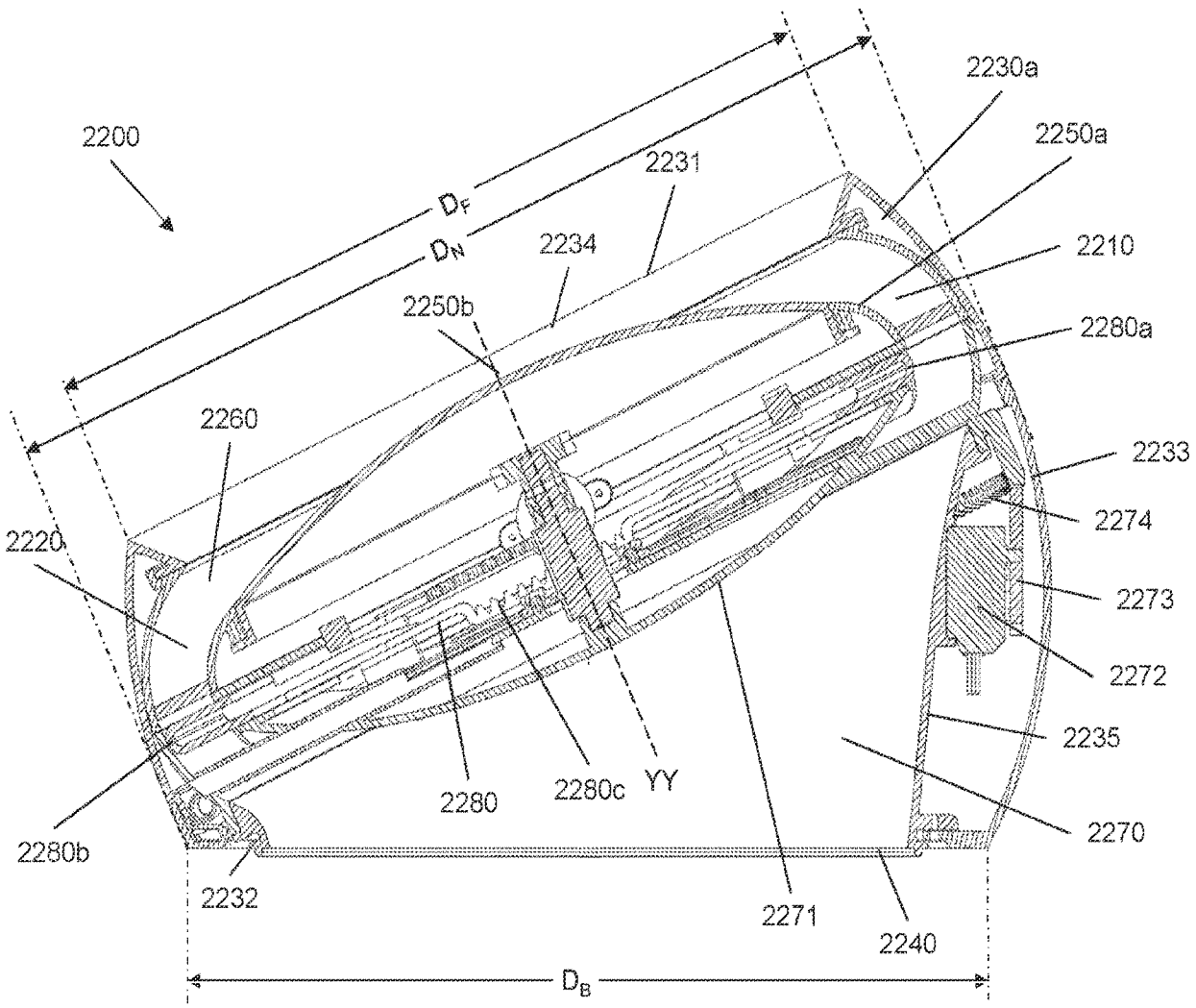
FIG. 15 is a vertical cross-sectional view of the spherical nozzle taken along line A-A of FIG. 13.
Figure 16:
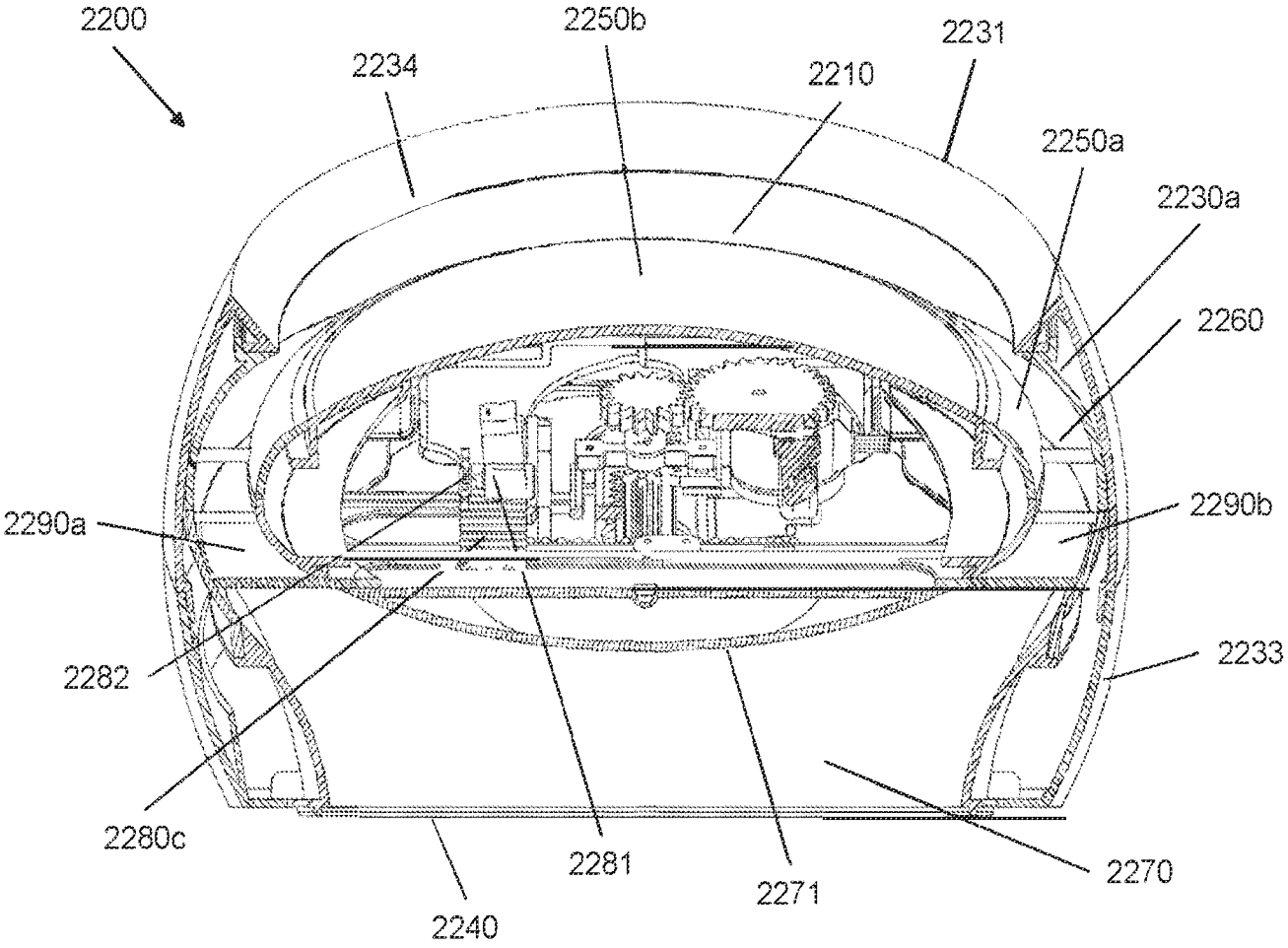
FIG. 16 is a vertical cross-sectional view of the spherical nozzle taken along line B-B of FIG. 14.
Figure 17:
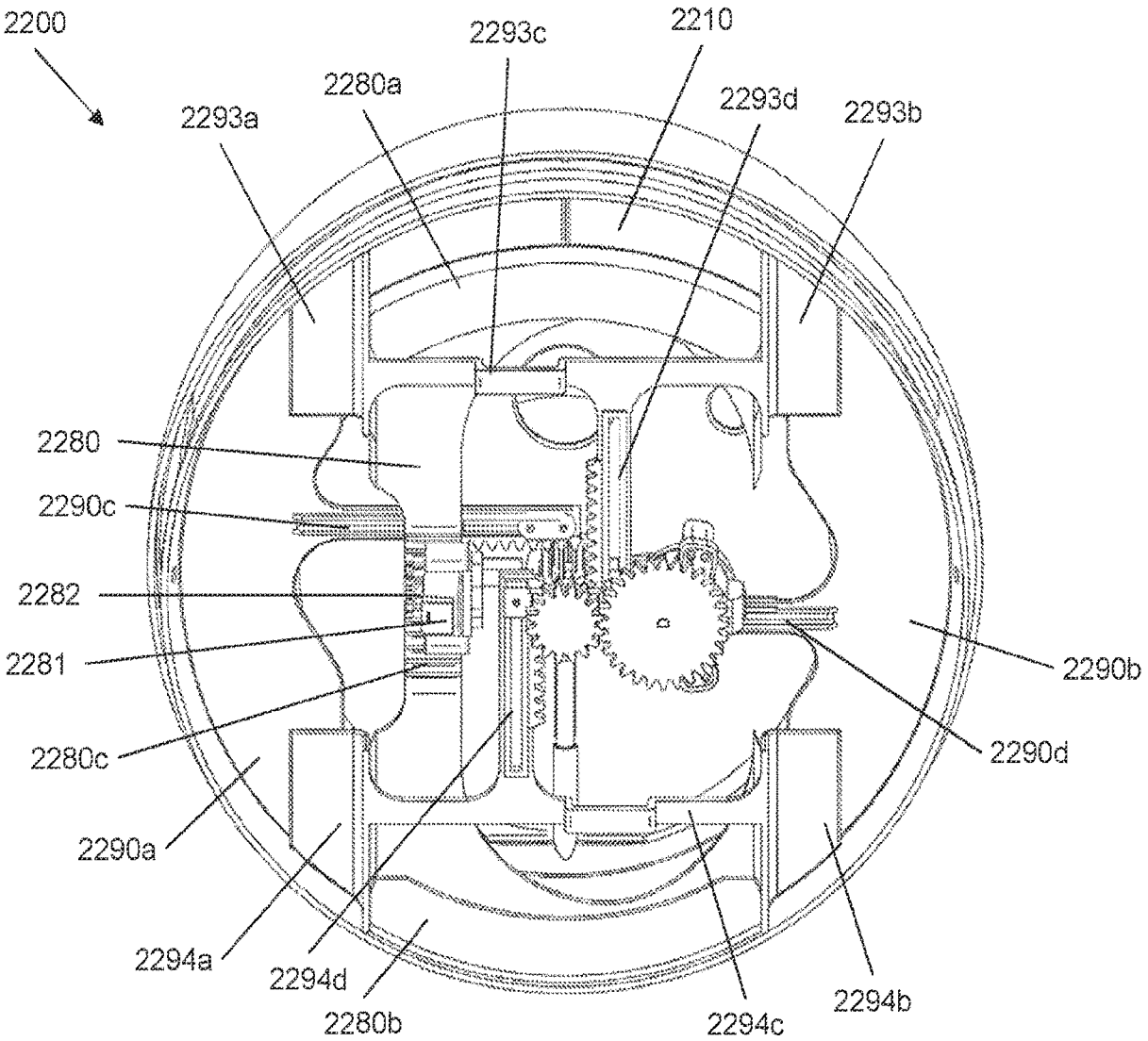
FIG. 17 is a top view of the spherical nozzle of FIG. 11 with an upper portion removed.
Figure 18:
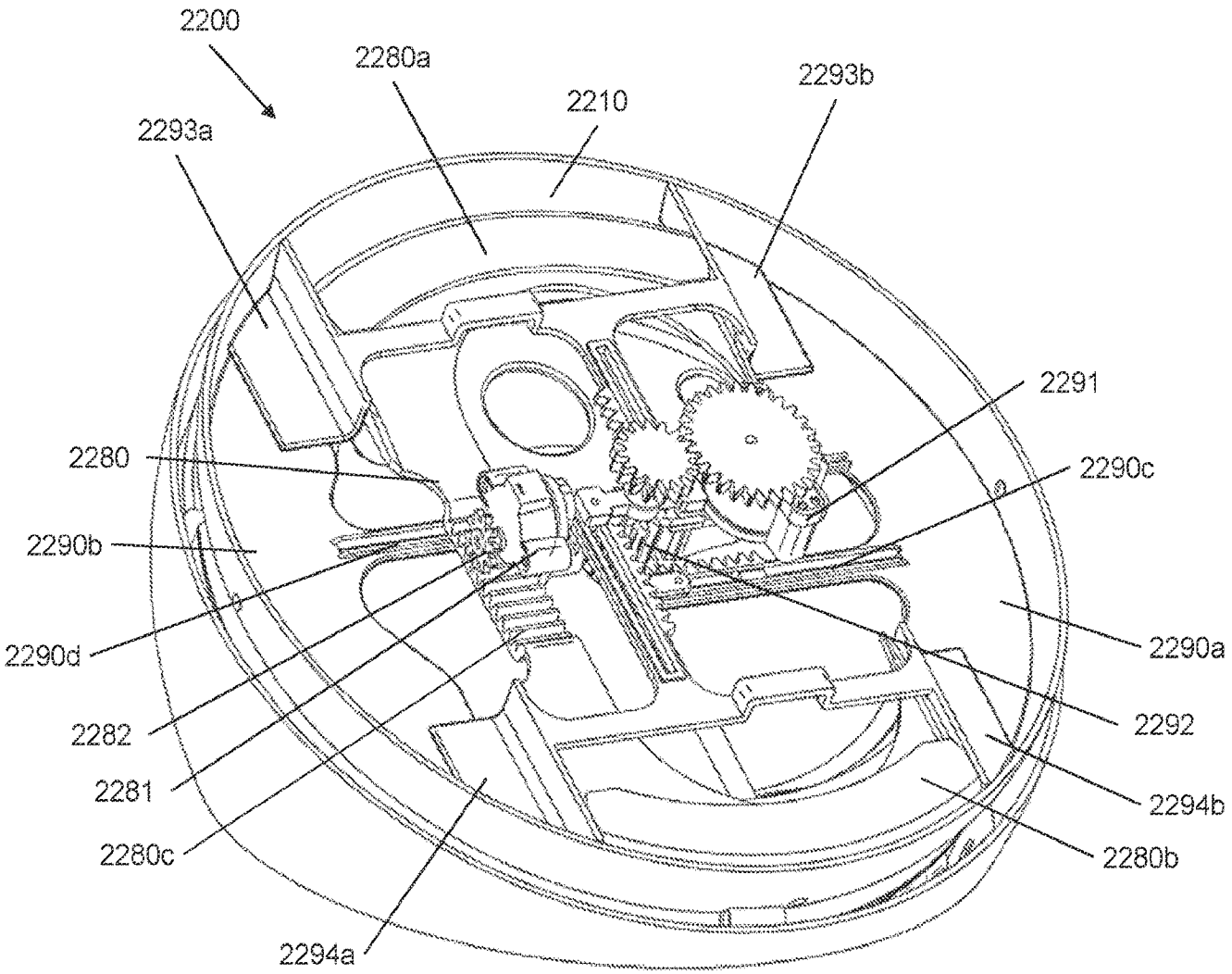
FIG. 18 is an isometric view of the spherical nozzle of FIG. 11 with an upper portion removed.

The construction and operation of the nozzle 2200 will be described in more detail below in relation to FIGS. 11 to 19*c*. FIG. 11 shows an isometric view of the nozzle 2200 of the fan assembly 2000 of FIGS. 9 and 10. FIGS. 12, 13 and 14 then show top, front and side views of the nozzle 2200. FIG. 15 then shows a sectional view through line A-A of FIG. 13, whilst FIG. 16 shows a sectional view through line B-B of FIG. 13. FIGS. 17 and 18 then show top and isometric views of the nozzle 2200 with the guide surface and an upper portion of the nozzle body removed.

As described above, the nozzle 2200 has the general shape of a truncated sphere, with a first truncation forming a circular face 2231 of the nozzle and a second truncation forming a circular base 2232 of the nozzle body 2230. The nozzle body 2230 therefore comprises an outer wall 2233 that defines the truncated spherical shape. The outer wall 2233 then defines a circular opening on the circular face 2231 of the nozzle 2200 and a circular opening on the circular base 2232 of the nozzle body 2230. The nozzle body 2230 also comprises a lip 2234 that extends inwardly from the edge of the outer wall 2233 that forms the first truncation. This lip 2234 is generally frustoconical in shape and tapers inwardly towards the guide surface 2250.

The nozzle body 2230 further comprises an inner wall 2235 that is disposed within the nozzle body 2230 and that defines the single internal air passageway 2270 of the nozzle 2200. The inner wall 2235 is entirely curved and has a generally circular cross-section, with the cross-sectional area of the inner wall 2235 in a plane that is parallel to either the face 2231 or base 2232 of the nozzle body 2230 varying between the air inlet 2240 and the one or more air outlets 2210, 2220. In particular, the inner wall 2235 widens or flares outwardly adjacent the air inlet 2240 and then narrows adjacent the air outlets 2210, 2220. The inner wall 2235 therefore generally conforms to the shape of the nozzle body 2230.

The inner wall 2235 has a circular opening at its lower end that is located concentrically within the circular opening of the circular base 2232 of the nozzle 2200, with this lower circular opening of the inner wall 2235 providing the air inlet 2240 for receiving the airflow from the body 2100. The inner wall 2235 also has a circular opening at its upper end that is located concentrically within the circular opening of the circular face 2231 of the nozzle body 2230. An inwardly curved upper end of the inner wall 2235 then meets/abuts with the lip 2234 that tapers inwardly from the outer wall 2233 to define the circular opening of the circular face 2231 of the nozzle body 2230.

The guide surface 2250 is then located concentrically with the upper circular opening of the inner wall 2235, and offset relative to the upper circular opening of the inner wall 2235 along the central axis of the upper circular opening of the inner wall 2235, such that the gap 2260 is therefore defined by the space between the inner wall 2235 and an adjacent portion of guide surface 2250. The inwardly curved upper end of the inner wall 2235 then overlaps/overhangs the circumferential portion 2250*a* of the guide surface 2250 to ensure that the angle at which an air flow exits the nozzle 2200 is sufficiently shallow to optimise the resultant air flow generated by the nozzle 2200. In particular, the angle at which an air flow exits the nozzle 2200 will determine the distance of the convergent point along the central axis (YY) of the guide surface 2250 and the angle at which air flows will collide at the convergent point. The tapering outer surface of the lip 2234 then minimises the impact of this overhang on the angular range through which the air flow can be varied.

In this embodiment, two separate valve mechanisms are then located beneath the guide surface 2250. The first of these is a flow vectoring valve that is arranged to control the air flow from the air inlet 2240 to the first and second air outlets 2210, 2220 by adjusting the size (i.e. open area) of the first air outlet 2210 relative to the size of the second air outlet 2220 while keeping the size of the aggregate air outlet of the nozzle 2200 constant. The second of these valve mechanisms is a mode switching valve that is arranged to change the air delivery mode of the nozzle 2200 from a directed mode to a diffuse mode. Both valve mechanisms will be described in more detail below.

The nozzle 2200 further comprises an internal air directing or diverting surface 2271 beneath both valve mechanisms, with the air directing surface 2271 being arranged to direct the airflow within the single air inlet passageway 2270 towards the gap 2260, and therefore towards the first and second air outlets 2210, 2220. In this embodiment, this air directing surface 2271 is convex and substantially disk-shaped, and is therefore similar in form to the guide surface 2250, and is aligned/concentric with the guide surface 2250.

Both valve mechanisms are therefore housed within a space defined between the guide surface 2250 and the air directing surface 2271.

In this embodiment, the internal air passageway 2270 that extends between the air inlet 2240 and the gap 2260 forms a plenum chamber that functions to equalise the pressure of the air flow received from the body 2100 of the fan assembly 2000 for more even distribution to the gap 2260, and therefore to the air outlets 2210, 2220. The air directing surface 2271 therefore forms an upper surface of the plenum chamber defined by the internal air passageway 2270.

The flow vectoring valve comprises a single valve member 2280 mounted beneath the guide surface 2250 and above the air directing surface 2271. The flow vectoring valve member 2280 is arranged to move translationally between a first end position and a second end position. In particular, the flow vectoring valve member 2280 is arranged to move rectilinearly (i.e. in a straight line) between a first end position and a second end position. Specifically, the flow vectoring valve member 2280 is arranged to move laterally (i.e. sideways, from side to side) relative to the guide surface 2250 between a first end position and a second end position. In the first end position the first air outlet 2210 is maximally occluded (i.e. occluded to the maximum extent possible, such that the size of the first air outlet is at a minimum) by the valve member 2280 and the second air outlet 2220 is maximally open (i.e. open to the maximum extent possible, such that the size of the second air outlet is at a maximum), whilst in the second end position the second air outlet 2220 is fully closed by the valve member 2280 and the first air outlet 2210 is maximally open. When the valve member 2280 moves between its two extreme positions the size/open area of the aggregate/combined air outlet remains constant.

When at a minimum the first and/or second air outlets 2210, 2220 may be fully occluded/closed. However, when at a minimum the first and/or second air outlets 2210, 2220 may be at least open to a very small extent as doing so can provide that any tolerances/inaccuracies arising during manufacture will not lead to small gaps that could induce additional noise (e.g. whistling) when air passes through.

In the illustrated embodiment, the valve member 2280 has a first end section 2280*a* that maximally occludes the first air outlet 2210 when the valve member 2280 is in the first end position, and an opposing second end section 2280*b* that maximally occludes the second air outlet 2220 when the valve member 2280 is in the second end position. The distal edges of the first and second end sections 2280*a*, 2280*b* of the valve member 2280 are both arcuate in shape so as to correspond with the shape of an opposing surface of the nozzle body 2230 that partially defines the corresponding air outlet. In particular, the distal edge of each valve member has a radius of curvature that is substantially equal to a radius of curvature of the opposing surface of the nozzle body 2230. The first end section 2280*a* of the valve member 2280 can therefore abut (i.e. touch or be adjacent/proximate to) an opposing surface when in the first end position in order to occlude the first air outlet 2210, with this opposing surface thereby providing a first valve seat, whilst the second end section 2280*b* of the valve member 2280 can abut (i.e. touch or be adjacent/proximate to) an opposing surface when in the second end position in order to occlude the second air outlet 2220, with this other opposing surface thereby providing a second valve seat. In addition, the arcuate shape of the distal edges of the first and second end sections 2280*a*, 2280*b* of the valve member 2280 also provide that the distal edge of the first end section 2280*a* will be substantially flush with an adjacent edge of the guide surface 2250 when in the second end position and that the distal edge of the second end section 2280*b* will be substantially flush with an adjacent edge of the guide surface 2250 when in in the first end position.

The flow vectoring valve further comprises a valve motor 2281 that is arranged to cause translational movement of the valve member 2280 relative to the guide surface 2250 in response to signals received from the main control circuit. To do so, the valve motor 2281 is arranged to rotate a pinion 2282 that engages with a linear rack 2280*c* provided on the valve member 2280. In this embodiment, the linear rack 2280*c* is provided on an intermediate section of the valve member that extends between the first and second end sections 2280*a*, 2880*b*. Rotation of the pinion 2282 by the valve motor 2281 will therefore result in the linear movement of the valve member 2280.

The mode switching valve is arranged to change the air delivery mode of the nozzle 2200 from a directed mode to a diffuse mode. In the directed mode, the mode switching valve closes off all but the first and second air outlets 2210, 2220 that are used to provide a directed air flow from the nozzle (i.e. covers/occludes those portions of the gap 2260 that separate the pair of arcuate slots). In this directed mode, the flow vectoring valve is then used to control the direction of the air flow emitted from the nozzle 2200 by just the first and second air outlets 2210, 2220. When switching from directed mode to diffuse mode, the mode switching valve opens the remainder of the gap 2260 (i.e. opens those portions of the gap 2260 that separate the pair of arcuate slots). In this diffuse mode, the entire gap 2260 can then become a single air outlet of the nozzle 2200 thereby providing a more diffuse, low pressure flow of air. In addition, the opening up of the entire gap 2260 by the mode switching valve provides that the air leaving the nozzle 2200 can be distributed around the entire periphery/circumference of the guide surface 2250 and all directed to the convergent point such that the resultant air flow generated by the nozzle 2200 will be directed substantially perpendicular relative to the face 2231 of the nozzle 2200. In this embodiment, the angle of the face 2231 of the nozzle 2200 relative to the base 2232 of the nozzle 2200, and therefore relative to the base of the fan assembly 2000, is such that when positioned on an approximately horizontal surface the resultant air flow generated by the fan assembly 2000 when the nozzle 2200 is in the diffuse mode will be directed in a generally upwards direction.

This dual mode configuration is particularly useful when the nozzle is intended for use with a fan assembly that is configured to provide purified air as the user of such a fan assembly may wish to continue to receive purified air from the fan assembly without the cooling effect produced by the higher pressure, focused airflow provided in directed mode. For example, this may be the case in winter when the user may consider the temperature to be too low to make use of the cooling effect provided by the directed mode airflow. In such a situation, the user can control the air delivery mode by manipulating the user interface. In response to these user inputs, a main control circuit would then cause the mode switching valve members to move from the closed position to the open position so that the entire gap then becomes a single air outlet of the nozzle thereby providing a more diffuse, low pressure flow of air. Furthermore, in preferred embodiments, the angle of the face of the nozzle relative to the base of the nozzle, and therefore relative to the base of the fan assembly, is such that when positioned on an approximately horizontal surface the resultant air flow generated by the fan assembly when the nozzle is in the diffuse mode will be directed in a generally upwards direction. These embodiments therefore also provide that the diffuse mode airflow is delivered to the user indirectly, thereby further decreasing the cooling effect produced by the airflow.

In the illustrated embodiment, the mode switching valve comprises a pair of mode switching valve members 2290*a*, 2290*b* mounted beneath the guide surface 2250 and above the air directing surface 2271. These mode switching valve members 2290*a*, 2290*b* are arranged to move laterally relative to the guide surface 2250 (i.e. translationally) between a closed position and an open position. In the closed position, the portions of the gap 2260 between the arcuate slots (i.e. between the slots that provide the first and second air outlets 2210, 2220) are occluded by the mode switching valve members 2290*a*, 2290*b*, whilst in the open position the portions of the gap 2260 between the arcuate slots are open. These mode switching valve members 2290*a*, 2290*b* can therefore be considered to be moveable covers.

In the illustrated embodiment, the mode switching valve members 2290*a*, 2290*b* are arranged such that in the closed position they each occlude the separate, diametrically opposed portions of the gap 2260 that are between one end of the first air outlet 2210 and an adjacent end of the second air outlet 2220. To do so, the mode switching valve members 2290*a*, 2290*b* are arranged such that in the closed position they each extend between opposing ends of the first air outlet 2210 and the adjacent end of the second air outlet 2220.

Each of the mode switching valve members 2290*a*, 2290*b* is substantially planar, with a distal edge of the valve member then being arcuate in shape so as to correspond with the shape of an opposing surface of the nozzle body 2230 that partially defines the gap 2260. In particular, the distal edge of each valve member has a radius of curvature that is substantially equal to a radius of curvature of the opposing surface of the nozzle body 2230. The distal edge of each of the valve members 2290*a*, 2290*b* can therefore abut against the opposing surface (i.e. the corresponding valve seat) when in the closed position in order to occlude a portion of the gap 2260 between the arcuate slots. In addition, the arcuate shape of the distal edge of each of the valve members 2290*a*, 2290*b* also provides that the distal edge will be substantially flush with an adjacent edge of the guide surface 2250 when in the open position. Each of the mode switching valve members 2290*a*, 2290*b* is then provided with a valve stem 2290*c*, 2290*d* that extends from the proximal edge of the valve member.

The mode switching valve further comprises a mode switching valve motor 2291 that is arranged to cause translational movement of the mode switching valve members 2290*a*, 2290*b* relative to the guide surface 2250 in response to signals received from the main control circuit. To do so, the valve motor 2291 is arranged to cause rotation of a pinion 2292 that engages with linear racks provided on each of the valve stems 2290*c*, 2290*d*. Rotation of the pinion 2292 by the valve motor 2291 will therefore result in the linear movement of both valve members 2290*a*, 2290*b*. In this embodiment, rotation of the pinion 2292 by the valve motor 2291 is achieved using a set of gears, with a drive gear mounted on the shaft of the valve motor 2291 engaging a driven gear that is fixed to the pinion 2292, with the driven gear and the pinion 2292 thereby forming a compound gear.

In the embodiment illustrated in FIGS. 15 to 18, the mode switching valve further comprises two pairs of movable baffles 2293, 2294 that are arranged to assist with channeling the air emitted from the first and second air outlets 2210, 2220 respectively when the nozzle 2200 is in directed mode. In particular, the first pair of movable baffles 2293*a*, 2293*b* are arranged to assist with channeling the air emitted from the first air outlet 2210 when the nozzle 2200 is in directed mode, whilst the second pair of movable baffles 2294*a*, 2294*b* are arranged to assist with channeling the air emitted from the second air outlet 2220 when the nozzle 2200 is in directed mode. These two pairs of movable baffles 2293, 2294 are therefore arranged to be extended when the nozzle 2200 is in directed mode, and retracted when the nozzle 2200 is in diffuse mode so as to avoid the baffles from obstructing the gap 2260.

Each pair of movable baffles 2293, 2294 comprises a first moveable baffle 2293*a*, 2294*a* and a second moveable baffle 2293*b*, 2294*b*, with the first moveable baffle 2293*a*, 2294*a* and second moveable baffle 2293*b*, 2294*b* being provided at opposite ends of an elongate strut 2293*c*, 2294*c*. Each moveable baffle 2293*a*, 2293*b*, 2294*a*, 2294*b* has an approximately L-shaped cross section, with a first planar section extending downwardly from the end of the strut 2293*c*, 2294*c* to which the baffle is attached, and a second planar section then extending from the bottom end of the first planar section in a direction that is parallel with the length of the strut 2293*c*, 2294*c*. The first and second planar sections of each baffle then also extend in a direction that is perpendicular to the length of the strut 2293*c*, 2294*c*. The first planar section of each baffle then defines an end of one of the first and second air outlets 2210, 2220. A distal edge of the second planar section of each baffle is then arcuate in shape so as to correspond with the shape of an opposing surface of the nozzle body 2230 that partially defines the gap 2260. In particular, the distal edge of each baffle has a radius of curvature that is substantially equal to a radius of curvature of the opposing surface of the nozzle body 2230. The distal edge of the second planar section of each baffle can therefore abut against an opposing surface when in the closed position. The second planar section of each baffle is then further arranged to overlap with a portion of the proximal edge of an adjacent mode switching valve member 2290*a*, 2290*b* so as to ensure that there is no route by which air can exit the nozzle 2200 between the baffle and the adjacent mode switching valve member 2290*a*, 2290*b*.

In this embodiment, these pairs of movable baffles 2293, 2294 are arranged to move laterally relative to the guide surface 2250 (i.e. translationally) between an extended position when the nozzle 2200 is in directed mode and a retracted position when the nozzle 2200 is in diffuse mode. To do so, each pair of movable baffles 2293, 2294 is provided with an actuator arm 2293*d*, 2294*d* that extends perpendicularly from the corresponding strut 2293*c*, 2294*c* at a position part-way between the ends of the strut 2293*c*, 2294*c*. These actuator arms 2293*d*, 2294*d* are each provided with a linear rack that engages with the pinion 2292 of the mode switching valve. Rotation of the pinion 2292 by the mode switching valve motor 2291 will therefore result in the linear movement of both pairs of movable baffles 2293, 2294. Consequently, when the mode switching valve is used to change the air delivery mode of nozzle 2200 between directed mode and diffuse mode, activation of the mode switching valve motor 2291 will cause rotation of the pinion 2292 that will in turn cause mode switching valve members 2290*a*, 2290*b* to move between a closed position and an open position, and will also simultaneously cause the pairs of movable baffles 2293, 2294 to move between an extended position and a retracted position.

In FIGS. 15 to 18 the nozzle 2200 is shown in directed mode, with the mode switching valve members 2290*a*, 2290*b* in the closed position and both pairs of movable baffles 2293, 2294 in the extended position. The portions of the gap 2260 that are between the first air outlet 2210 and the second air outlet 2220 are therefore occluded by the mode switching valve members 2290*a*, 2290*b*, with the first planar section of each pair of movable baffles 2293, 2294 then defining opposite ends of the first and second air outlets 2210, 2220 in order to assist in channeling the air over the guide surface 2500 and towards the convergent point.

In order to switch the nozzle 2200 to diffuse mode, the mode switching valve motor 2291 is activated so as to cause a rotation of the pinion 2292 that will in turn cause mode switching valve members 2290*a*, 2290*b* to move from the closed position to the open position. In the open position, the mode switching valve members 2290*a*, 2290*b* are retracted into the space defined between the guide surface 2250 and the air directing surface 2271 such that they no longer obstruct the portions of the gap 2260 that are between the first air outlet 2210 and the second air outlet 2220. Simultaneously, this rotation of the pinion 2292 will also cause the pairs of movable baffles 2293, 2294 to move from the extended position to the retracted position. In the retracted position, the pairs of movable baffles 2293, 2294 are retracted into the space defined between the guide surface 2250 and the air directing surface 2271 such that they no longer obstruct the portions of the gap 2260 that are between the first air outlet 2210 and the second air outlet 2220. Preferably, when switching the nozzle 2200 from directed mode to diffuse mode, the flow vectoring valve motor 2281 is also activated so as to cause a rotation of the pinion 2282 that will in turn cause the flow vectoring valve member 2280 to move to a central position in which the first air outlet 2210 and the second air outlet 2220 are equal in size. In this configuration, the entire gap 2260 then becomes a single air outlet of the nozzle 2200 thereby providing a more diffuse, low pressure flow of air.

In the embodiment illustrated in FIGS. 15 to 18, the nozzle 2200 is also arranged so that the position of the pair of arcuate slots on the circular face of the nozzle 2200 can be varied. Specifically, the angular position of the pair of arcuate slots with respect to the central axis (YY) of the guide surface 2250 is variable. The nozzle 2200 therefore further comprises an outlet rotation motor 2272 that is arranged to cause rotational movement of the pair of arcuate slots around the central axis (YY) of the guide surface 2250. To do so, the outlet rotation motor 2272 is arranged to cause rotation of a pinion 2273 that engages with an arc-shaped rack 2274 that is connected to the air directing surface 2271. The air directing surface 2271 is then rotationally mounted within the nozzle body 2230, with the flow vectoring valve and mode switching valve mechanisms then being supported by the air directing surface 2271. Rotation of the pinion 2273 by the outlet rotation motor 2272 will therefore result in the rotational movement of the air directing surface 2271 within the nozzle body 2230 that will in turn cause rotation of both the flow vectoring valve and mode switching valve around the central axis (YY) of the guide surface 2250. Given that the pair of arcuate slots that form the first and second air outlets 2210, 2220 are defined by those portions of the gap 2260 that are not occluded by the mode switching valve members 2290*a*, 2290*b*, rotation of the mode switching valve results in a change in the angular position of the pair of arcuate slots with respect to the central axis (YY) of the guide surface 2250.

Figure 19A:
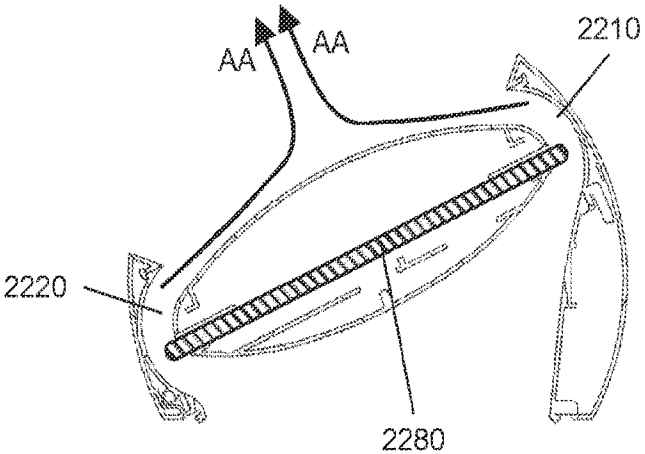
FIG. 19*a* is a simplified vertical cross-sectional view of the spherical nozzle illustrating a valve member in a first position.
Figure 19B:
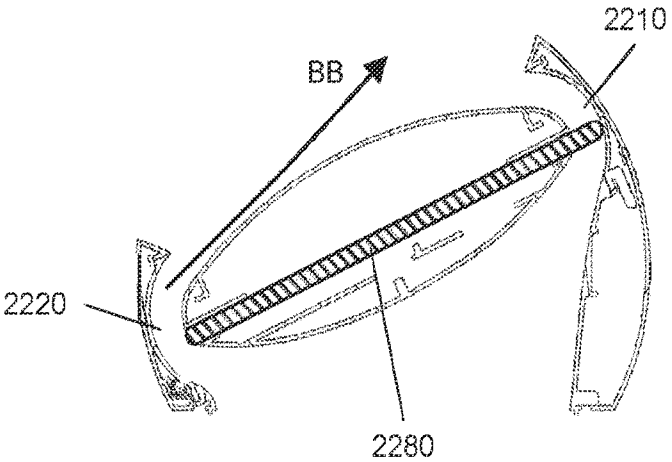
FIG. 19*b* is a simplified vertical cross-sectional view of the spherical nozzle illustrating a valve member in a second position.
Figure 19C:
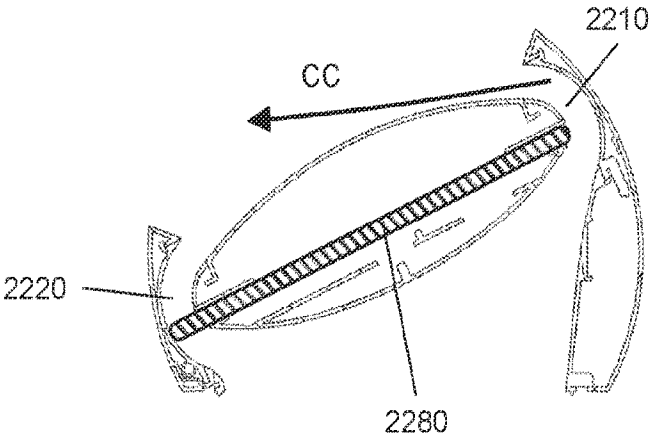
FIG. 19*c* is a simplified vertical cross-sectional view of the spherical nozzle illustrating a valve member in a third position.

Turning now to FIGS. 19*a* to 19*c*, these show three potential resultant air flows that can be achieved, when the nozzle 2200 is in directed mode, by varying the size of the first air outlet 2210 relative to the size of the second air outlet 2220 while keeping the size of the aggregate directed mode air outlet of the nozzle 2200 constant.

In FIG. 19*a*, the flow vectoring valve is arranged with the flow vectoring valve member 2280 in the central position in which the first air outlet 2210 and the second air outlet 2220 are equal in size such that an equal amount of air flow is emitted from the first air outlet 2210 and the second air outlet 2220. The first and second air outlets 2210, 2220 are oriented towards the convergent point that is aligned with the central axis (YY) of the guide surface 2250. When the two air flows have the same strength, as will be the case in the FIG. 19*a*, the resultant air flow will be directed forwards from (i.e. substantially perpendicular relative to) the face 2231 of nozzle 2200, as indicated by arrows AA.

In FIG. 19*b*, the flow vectoring valve is arranged with the flow vectoring valve member 2280 in the first end position in which the first air outlet 2210 is maximally occluded and the second air outlet 2220 is maximally open. This means that most, if not all, of the air flow entering the nozzle 2200 will be emitted through the second air outlet 2220. The air flow will be directed to flow over the guide surface 2250 as normal, but since it will not collide with any significant air flow that is emitted from the first air outlet 2210 it will continue on its flow path, as indicated by arrows BB.

In FIG. 19*c*, the flow vectoring valve is arranged with the flow vectoring valve member 2280 in the second end position in which the second air outlet 2220 is maximally occluded and the first air outlet 2210 is maximally open. This means that most, if not all, of the air flow entering the nozzle 2200 will be emitted through the first air outlet 2210. The air flow will be directed to flow over the guide surface 2250 as normal, but since it will not collide with any significant air flow that is emitted from the second air outlet 2220 it will continue on its flow path, as indicated by arrows CC.

As discussed in relation to FIGS. 8*a* to 8*c* above, it will be readily understood that the examples of FIGS. 19*a*, 19*b* and 19*c* are merely representative, and actually represent some of the extreme cases. By utilising a control circuit to control the flow vectoring valve motor 2281 connected to the flow vectoring valve member 2280 it is possible to achieve a wide variety of resultant air flows. The direction of the resultant air flows can be further varied by controlling the outlet rotation motor 2272 to adjust the angular position of the first and second air outlets 2210, 2220.

Figure 20:
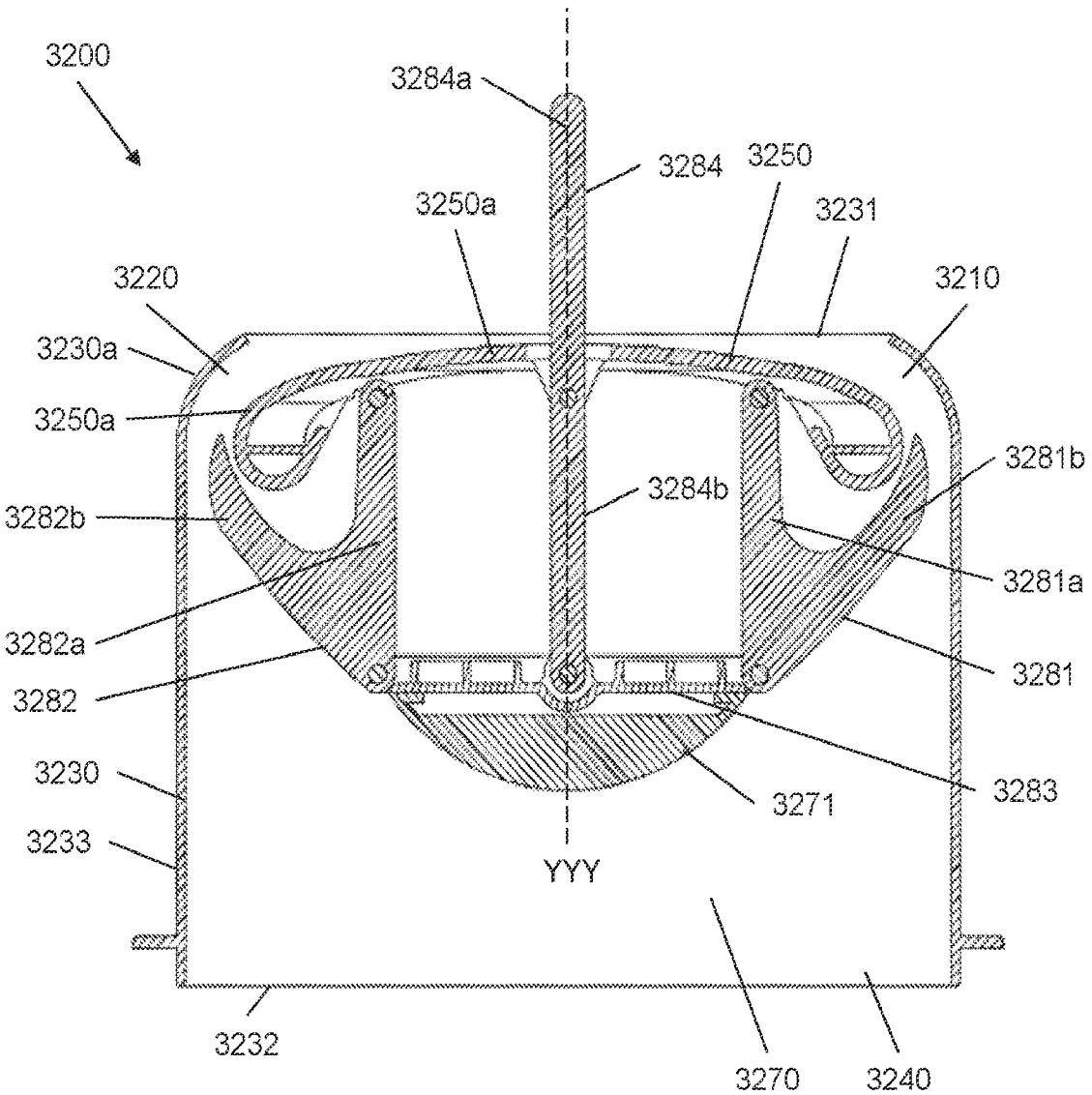
FIG. 20 is a vertical cross-sectional view of a cylindrical nozzle of a third embodiment.
Figures 21A, 21B:
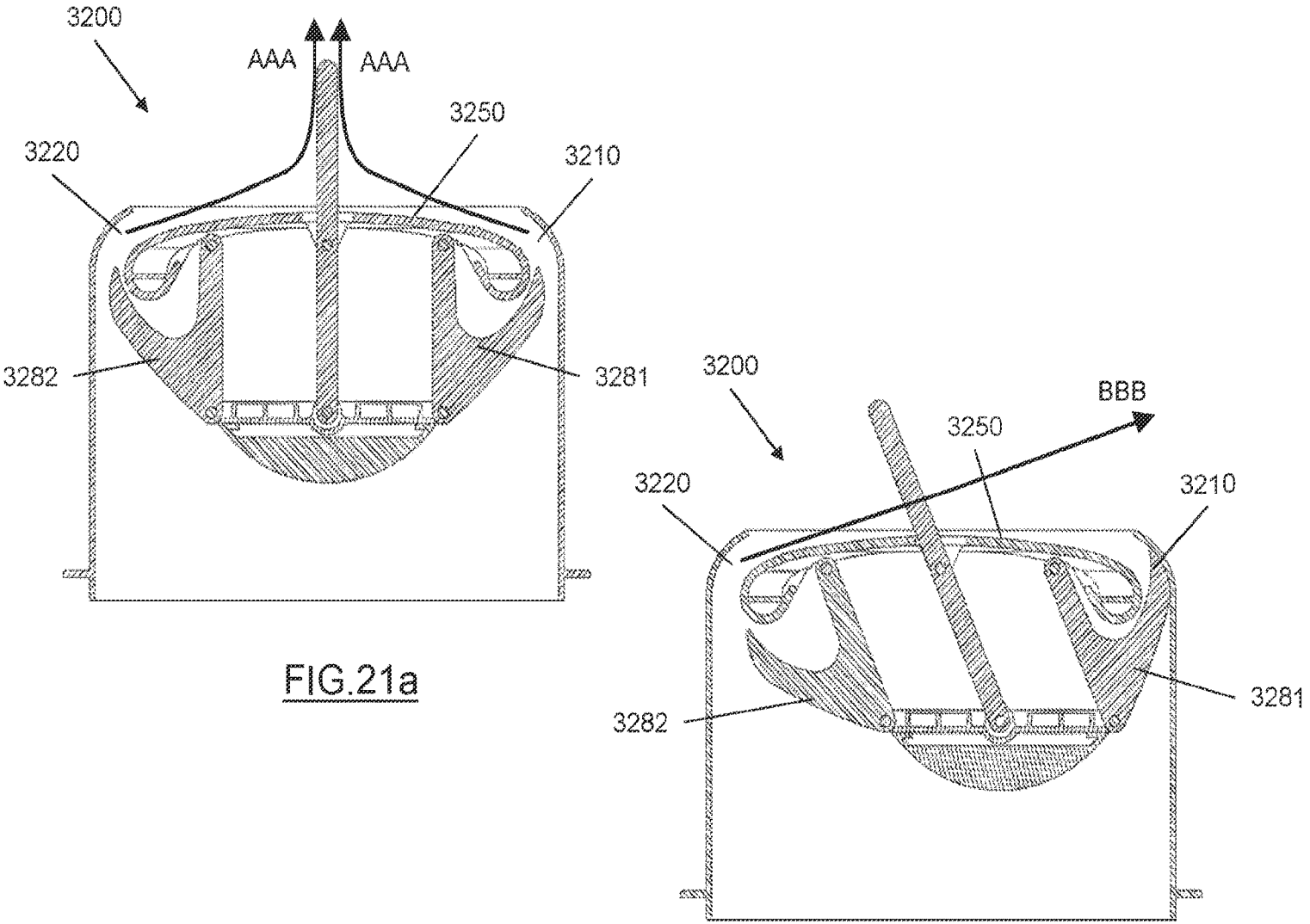
FIG. 21*a* is a vertical cross-sectional view of the cylindrical nozzle illustrating a valve member in a first position.
FIG. 21*b* is a vertical cross-sectional view of the cylindrical nozzle illustrating a valve member in a second position.

FIGS. 20, 21*a* and 21*b* then show sectional views of a further embodiment of a nozzle 3200 for a fan assembly. In this further embodiment, the nozzle 3200 is suitable for use with a fan body that is substantially the same as that of the first and second embodiments described above and the fan body has therefore not been further illustrated nor described. However, rather than having an elongate annular or truncated spherical shape, the nozzle 3200 of this further embodiment is generally cylindrical in shape such that there are differences in the construction of the nozzle 3200 and also differences in the flow vectoring valve provided within the nozzle 3200.

In this embodiment, the nozzle 3200 has an open lower end which provides an air inlet 3240 for receiving the primary airflow from the body of the fan assembly. The nozzle 3200 is arranged such that the external surface of an outer wall of the nozzle 3200 will converge with the outer edge when mounted on the fan body.

The nozzle 3200 comprises a nozzle body, outer casing or housing 3230 that defines the outermost surfaces of the nozzle and therefore defines the external shape or form of the nozzle 3200. In the illustrated embodiment, the nozzle body/outer casing 3230 of the nozzle 3200 has the general shape of a right circular cylinder, and therefore has a circular face 3231 and a circular base 3232. The angle of the face 3231 of the nozzle body 3230 relative to the base 3232 of the nozzle body 3230 is fixed. In the illustrated embodiment, this angle is 0 degrees such that the circular face 3231 and circular base 3232 are substantially parallel.

The nozzle 3200 then further comprises a fixed, external guide surface 3250 that is located concentrically within the opening at the circular face 3231 of the nozzle body 3230 such that this external guide surface 3250 is at least partially exposed within the opening, with a portion of the nozzle body 3230 extending around the periphery of the guide surface 3250. The external guide surface 3250 is therefore outward facing (i.e. faces away from the centre of the nozzle).

In the illustrated embodiment, this guide surface 3250 is convex and substantially disk-shaped; however, in alternative embodiments the guide surface 3250 could be flat or only partially convex. An inwardly curved upper portion 3230*a* of the nozzle body 3230 then overlaps/overhangs a circumferential portion 3250*a* of the guide surface 3250. The outermost central portion 3250*b* of the convex guide surface is then offset relative to the outermost point of the open circular face 3231 of the nozzle body 3230. In particular, the outermost point of the open circular face 3231 of the nozzle body 3230 is in front of the outermost portion 3250*b* of the guide surface.

The circumferential portion 3250*a* of the guide surface 3250 and an opposing portion of the nozzle body 3230 together define a generally annular gap between them, with two diametrically opposed portions of this gap 3260 then forming a pair of congruent, circular arc shaped slots that provide the first and second air outlets 3210, 3220 of the nozzle 3200. The guide surface 3250 therefore provides an intermediate surface that spans the area between the first and second air outlets 3210, 3220. In other words, the guide surface 3250 forms an intermediate surface that extends across the space that separates the first and second air outlets 3210, 3220. In this embodiment, the portions of the gap that separate the pair of arcuate slots are each occluded by fixed covers (not shown). In contrast with the nozzle 2200 of the second embodiment, the nozzle 3200 of this further embodiment therefore only has a single, directed mode and does not have a separate diffuse mode.

In the illustrated embodiment, the pair of arcuate slots that provide the first and second air outlets 3210, 3220 each have an arc angle (i.e. the angle subtended by the arc at the centre of the circular face 3231) of approximately 60 degrees; however, they could each have an arc angle of anything from 20 to 110 degrees, preferably from 45 to 90 degrees, and more preferably from 60 to 80 degrees.

The first and second air outlets 3210, 3220 are approximately the same size and together form an aggregate or combined air outlet of the spherical nozzle 3200. The first air outlet 3210 and the second air outlet 3220 are located on opposing sides of the guide surface 3250, and are orientated to direct an emitted air flow over a portion of the guide surface 3250 that is adjacent to the respective air outlet and towards a convergent point that is aligned with a central axis (YYY) of the guide surface 3250. The first air outlet 3210, the second air outlet 3220 and the guide surface 3250 are then arranged such that emitted air flows are directed over a portion of the guide surface 3250 that is adjacent to the respective air outlet. In particular, the air outlets 3210, 3220 are arranged to emit an air flow in a direction that is substantially parallel to the portion of the guide surface 3250 adjacent the air outlet 3210, 3220. The convex shape of the guide surface 3250 then provides that the air flows emitted from the first and second air outlets 3210, 3220 will depart from the guide surface 3250 as they approach the convergent point so that these air flows can collide at and/or around the convergent point without interference from the guide surface 3250. When the emitted air flows collide, a separation bubble is formed that can assist in stabilizing the resultant jet or combined air flow formed when two opposing air flows collide.

In this embodiment, the nozzle body 3230 comprises an outer wall 3233 that defines the cylindrical shape of the nozzle 3200 and the single internal air passageway 3270 of the nozzle 3200. The outer wall 3233 also defines the circular opening on the circular face 3231 of the nozzle 3200 and the circular opening on the circular base 3232 of the nozzle body 3230. The lower circular opening of the outer wall 3233 provides the air inlet 3240 for receiving the primary airflow from the fan body. The nozzle body 3230 also comprises the upper portion 3230*a* that curves inwardly towards the central axis of the guide surface 3250.

The guide surface 3250 is then located concentrically with the upper circular opening of the outer wall 3233, and offset relative to the upper circular opening of the outer wall 3233 along the central axis of the upper circular opening of the outer wall 3233, such that the gap is therefore defined by the space between the upper circular opening of the outer wall 3233 and an adjacent portion of guide surface 3250.

A flow vectoring valve is then located beneath the guide surface 3250. The flow vectoring valve is arranged to control the air flow from the air inlet to the first and second air outlets 3210, 3220 by adjusting the size of the first air outlet 3210 relative to the size of the second air outlet 3220 while keeping the size of the aggregate air outlet of the nozzle 3200 constant.

The flow vectoring valve comprises a first valve member 3281 and a second valve member 3282 that cooperate to adjust the size of the first air outlet 3281 relative to the size of the second air outlet 3282 while keeping the total air outlet of the nozzle 3200 constant. To do, the first valve member 3281 and the second valve member 3282 are linked so that they move simultaneously. The first valve member 3281 and the second valve member 3282 are therefore each arranged to be pivotable relative to the both the nozzle body 3230 and the guide surface 3250 between a first end position and a second end position. In the first end position the first air outlet 3210 is maximally occluded (i.e. occluded to the maximum extent possible, such that the size of the first air outlet is at a minimum) by the first valve member 3281 whilst the second air outlet 3220 is maximally open (i.e. open to the maximum extent possible, such that the size of the second air outlet is at a maximum). In the second end position the second air outlet 3220 is maximally occluded by the second valve member 3282 whilst the first air outlet 3210 is maximally open.

When at a minimum the first and/or second air outlets 3210, 3220 may be fully occluded/closed. However, when at a minimum the first and/or second air outlets 3210, 3220 may be at least open to a very small extent as doing so can provide that any tolerances/inaccuracies arising during manufacture will not lead to small gaps that could induce additional noise (e.g. whistling) when air passes through.

In this embodiment, the first valve member 3281 is pivotally mounted beneath the guide surface 3250 at a location adjacent to the first air outlet 3210 and the second valve member 3282 is pivotally mounted beneath the guide surface 3250 at a location adjacent to the second air outlet 3220. The first valve member 3281 is then linked to the second valve member 3282 by a coupler 3283 such that first valve member 3281 and the second valve member 3283 pivot simultaneously. The guide surface 3250, first valve member 3281, second valve member 3282 and the coupler 3283 therefore form a planar quadrilateral linkage, specifically a parallelogram four-bar linkage. The first valve member 3281 and the second valve member 3282 therefore each comprise a link portion 3281*a*, 3282*a*, with a first end of the link portion being connected to the coupler 3283 by a hinge and a second end of the link portion being connected to the underside of the guide surface 3250 by another hinge. These link portions of the first and second valve members 3281, 3282 therefore function as cranks of the four-bar linkage.

The first valve member 3281 then further comprises a first valve arm 3281*b* that is arranged to maximally occlude the first air outlet 3210 when the first valve member 3281 is in the first end position and the second valve member 3282 further comprises a second valve arm 3282*b* that is arranged to maximally occlude the second air outlet 3220 when the valve member 3282 is in the second end position. The first valve arm 3281*b* extends from the first valve member 3281 into the first air outlet 3210 and the second valve arm 3282*b* extends from the second valve member 3282 into the second air outlet 3220. In particular, the first valve arm 3281*b* extends from the first end of the link portion 3281*a* of the first valve member 3281, and the second valve arm 3282*b* extends from the first end of the link portion 3282*a* of the second valve member 3282.

The flow vectoring valve further comprises a rod 3284 that is connected to the coupler 3283 such that movement of the rod 3284 causes simultaneous movement of the first valve member 3281 and second valve member 3282. In this embodiment, the rod 3284 extends out of the nozzle 3200 through the centre of the guide surface 3250, with an external portion 3284*a* of the rod 3284 being arranged to provide a user operable handle and an internal portion 3284*b* of the rod 3284 being pivotally connected to the coupler 3283. Between the external portion 3284*a* of the rod 3284 and the pivotal connection of the rod 3284 to the coupler 3283, the rod 3284 is then also pivotally connected just beneath the guide surface 2050.

The nozzle 3200 then further comprises an internal air directing/diverting surface 3271 disposed between the first valve member 3281 and the second valve member 3282 that is arranged to direct an airflow received from/within the single air inlet passageway 3270 towards the first and second air outlets 3210, 3220. In this embodiment, this air directing surface 3271 is convex, is substantially disk-shaped, and is mounted on to the lower surface of the coupler 3283. The air directing surface 3271 therefore moves with the coupler 3283 and is at all times disposed between the rearmost ends of the first valve member 3281 and the second valve member 3282 irrespective of the positions of the first valve member 3281 and the second valve member 3282. In addition, the surfaces of each of the first valve arm 3281*b* and the second valve arm 3282*b* that face the single internal air passageway 3270 are then also arranged to direct an airflow received from/within the single air inlet passageway 3270 towards the first and second air outlets 3210, 3220 respectively. In particular, these air directing surfaces of each of the first valve arm 3281*b* and the second valve arm 3282*b* are arranged to be generally continuous with the air directing surface 3271.

In this embodiment, the internal air passageway 3270 that extends between the air inlet 3240 and the first and second air outlets 3210, 3220 forms a plenum chamber that functions to equalise the pressure of the air flow received from the fan body for more even distribution to the first and second air outlets 3210, 3220. The air directing surface 3271 therefore forms an upper surface of the plenum chamber defined by the internal air passageway 3270.

FIGS. 21*a* and 21*b* show two potential resultant air flows that can be achieved by varying the size of the first air outlet 3210 relative to the size of the second air outlet 3220 while keeping the size of the aggregate air outlet of the nozzle 3200 constant.

In FIG. 21*a*, the flow vectoring valve is arranged with the first and second valve members 3281, 3282 in the central position in which the first air outlet 3210 and the second air outlet 3220 are equal in size such that an equal amount of air flow is emitted from the first air outlet 3210 and the second air outlet 3220. The first and second air outlets 3210, 3220 are oriented towards the convergent point that is aligned with a central axis (YYY) of the guide surface 3250. When, as will be the case in the FIG. 21*a* the two air flows have the same strength, the resultant air flow will be directed forwards from (i.e. substantially perpendicular relative to) the face 3231 of nozzle 3200, as indicated by arrows AAA.

In FIG. 21*b*, the flow vectoring valve is arranged with the first valve member 3281 and second valve member 3282 in the first end position in which the first air outlet 3210 is maximally occluded and the second air outlet 2220 is maximally open. This means that most, if not all, of the air flow entering the nozzle 3200 will be emitted through the second air outlet 3220. The air flow will be directed to flow over the guide surface 3250 as normal, but since it will not collide with any significant air flow that is emitted from the first air outlet 3210 it will continue on its flow path, as indicated by arrows BBB.

It will be readily understood that the examples of FIGS. 21*a* and 21*b* are merely representative, and actually represent some of the extreme cases. By utilising the user operable handle portion of the rod 3284 that is connected to the flow vectoring valve members 3281, 3282 it is possible to achieve a wide variety of resultant air flows.

Figure 22:
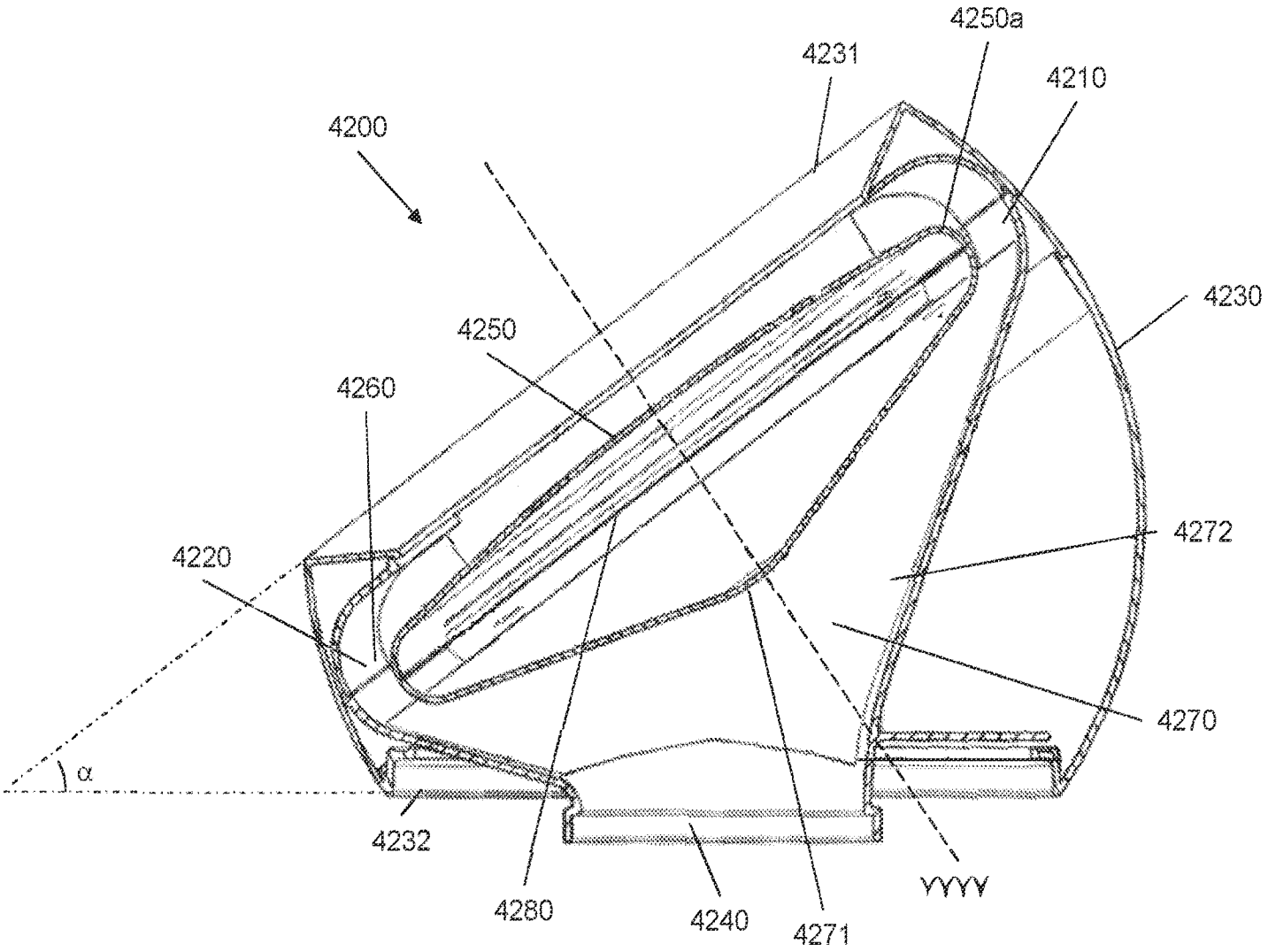
FIG. 22 is a vertical cross-sectional view of a spherical nozzle of a fourth embodiment.

FIG. 22 then shows a sectional view of a yet further embodiment of a nozzle 4200 for a fan assembly. In this further embodiment, the nozzle 4200 is suitable for use with a fan body that is substantially the same as that of the first, second and third embodiments described above and the fan body has therefore not been further illustrated nor described.

The nozzle 4200 of this fourth embodiment is similar to that of the second embodiment. In particular, the body 4230 of the nozzle 4200 of this fourth embodiment also has the general shape of a truncated sphere, with a first truncation forming a circular face 4231 of the nozzle and a second truncation forming a circular base 4232 of the nozzle body 4230, with the angle ($\alpha$) of the face 4231 of the nozzle body 4230 relative to the base 4232 of the nozzle body 4230 being fixed at approximately 35 degrees. However, the flow vectoring valve of this fourth embodiment differs from that used in the nozzle 2200 of the second embodiment.

In the nozzle 2200 of the second embodiment, the valve member 2280 is mounted beneath the guide surface 2250 and above the air directing surface 2271, and moves independently of both the guide surface 2250 and the air directing surface 2271. In contrast, in the nozzle of this fourth embodiment, the valve member 4280 comprises both the external guide surface 4250 and the internal air directing surface 4271, which are configured to move relative to the nozzle body 4230. In the illustrated embodiment, the guide surface 4250 is convex and substantially disk-shaped; however, in alternative embodiments the guide surface 4250 could be flat or only partially convex.

When the valve member 4280 is in the central position, the circumferential portion 4250*a* of the guide surface 4250 and an opposing portion of the nozzle body 4230 together define a generally annular gap 2260 between them, with two diametrically opposed portions of this gap 4260 then forming a pair of congruent, circular arc shaped slots that provide the first and second air outlets 4210, 4220 of the nozzle 4200.

In this embodiment, the first and second air outlets 4210, 4220 are approximately the same size and together form an aggregate or combined air outlet of the spherical nozzle 4200. The first air outlet 4210 and the second air outlet 2220 are located on opposing sides of the guide surface 4250, and are orientated to direct an emitted air flow over a portion of the guide surface 4250 that is adjacent to the respective air outlet and towards a convergent point that is aligned with a central axis (YYYY) of the guide surface 4250.

The single internal air passageway 4270 that extends between the air inlet 4240 and the first and second air outlets 4210, 4220 is then shaped so that the air flow does not reach these portions of the gap 4260 that are between the first and second air outlets 4210, 4220. In particular, the single internal air passageway is provided with sidewalls 4272 that are generally parallel with and extend between the end of the curved slot that provides the first air outlet 4210 and an adjacent end of the curved slot that provides the second air outlet 4220. The single internal air passageway 4270 therefore does not extend beyond the ends of the air outlets 4210, 4220 and only extends from the distal curved side/edge of one air outlet to the distal curved side/edge of the other outlet, and under the corresponding portion of the intermediate/guide surface 4250. In this arrangement, the single internal air passageway 4270 still provides a plenum region for the air flow received through the air inlet 4240 of the nozzle 4200 but restricts this to a region below and between the air outlets 4210, 4220.

When the flow vectoring valve is arranged with the valve member 4280 in the central position, the external guide surface 4250 is located concentrically within the open circular face 4231 of the nozzle body 4230 and the first air outlet 4210 and the second air outlet 4220 are equal in size such that an equal amount of air flow is emitted from the first air outlet 4210 and the second air outlet 4220. The resultant air flow will therefore be directed forwards from (i.e. substantially perpendicular relative to) the face 4231 of nozzle 4200.

When the flow vectoring valve is arranged with the valve member 4280 in the first end position, a first end of the valve member 4280 will abut (i.e. touch or be adjacent/proximate to) the opposing surface of the nozzle body 4230 and thereby maximally occlude the first air outlet 4210 whilst maximally opening the second air outlet 4220. The external guide surface will therefore have moved towards the first air outlet 3210 and away from the second air outlet 4210, and will no longer be in the concentric position. This means that most, if not all, of the air flow entering the nozzle 4200 will be emitted through the second air outlet 4220. The air flow will be directed to flow over the guide surface 4250 as normal, but since it will not collide with any significant air flow that is emitted from the first air outlet 4210 it will continue on its flow path.

When the flow vectoring valve is arranged with the valve member 4280 in the second end position, the second end of the valve member 4280 will abut (i.e. touch or be adjacent/proximate to) the opposing surface of the nozzle body 4230 and thereby maximally occlude the second air outlet 4220 whilst maximally opening the first air outlet 4210. The external guide surface will therefore have moved towards the second air outlet 4220 and away from the first air outlet 4210, and will not be in the concentric position. This means that most, if not all, of the air flow entering the nozzle 4200 will be emitted through the first air outlet 4210. The air flow will be directed to flow over the guide surface 4250 as normal, but since it will not collide with any significant air flow emitted that is from the second air outlet 4220 it will continue on its flow path.

It will be appreciated that individual items described above may be used on their own or in combination with other items shown in the drawings or described in the description and that items mentioned in the same passage as each other or the same drawing as each other need not be used in combination with each other. In addition, the expression "means" may be replaced by actuator or system or device as may be desirable. In addition, any reference to "comprising" or "consisting" is not intended to be limiting in any way whatsoever and the reader should interpret the description and claims accordingly.

Furthermore, although the invention has been described in terms of preferred embodiments as set forth above, it should be understood that these embodiments are illustrative only. Those skilled in the art will be able to make modifications and alternatives in view of the disclosure which are contemplated as falling within the scope of the appended claims. For example, those skilled in the art will appreciate that the above-described invention might be equally applicable to other types of environmental control fan assemblies, and not just free standing fan assemblies. By way of example, such a fan assembly could be any of a freestanding fan assembly, a ceiling or wall mounted fan assembly and an in-vehicle fan assembly.

By way of further example, each of the flow vectoring valve mechanisms described above are interchangeable between the various nozzle embodiments. In particular, a single pivoting valve member such as that described in relation to the first embodiment could be used in either the second or third nozzle embodiments. Similarly, a single linearly moveable valve member such as that described in relation to the second and fourth embodiments could be used in either the first or third nozzle embodiments. A pair of linked pivoting valve members such as that described in relation to the third embodiment could be used in any of the first, second and fourth nozzle embodiments.

As a yet further example, whilst in the second embodiment the portions of the gap between the first and second directed mode air outlets are occluded by moveable covers, they could equally be occluded by fixed covers, as is the case in the third embodiment, such that the nozzle of the second embodiment would then only have a single directed mode of air delivery. Inversely, the fixed covers of the third embodiment could be replaced by moveable covers such as those described in relation to the second embodiment, thereby providing the nozzle of the third embodiment with both directed and diffuse air delivery modes.

In addition, the nozzles and outlets of the above described embodiments could have different shapes. For example, rather than having the general shape of a circular arc, the slots that provide the first and second air outlets could each be elliptical arcs. Similarly, rather than having the general shape of a sphere, the nozzle of the second embodiment could have the general shape of an ellipsoid or spheroid. The nozzle of the third embodiment could also have the general shape of an elliptic cylinder, rather than having the general shape of a right circular cylinder. Also, the face of the nozzle could also differ in shape. In particular, rather than being circular, the face of the nozzle could be elliptical.

Additionally, whilst some of the above described embodiments make use of one or more valve members that are independent of and move relative to an external guide surface, it is also possible that the one or more valve members could comprise or otherwise be connected to the external guide surface such that both the valve members and the external guide surface move together relative to the nozzle body, as is the case in the fourth embodiment. Similarly, whilst some of the above described embodiments make use of one or more valve members that are independent of and move relative to an internal air directing surface, it is also possible that the one or more valve members could comprise or otherwise be connected to the internal air directing surface such that both the valve members and the internal air directing surface move together relative to the nozzle body, as is the case in the third embodiment.

Moreover, whilst some of the above described embodiments make use of a valve motor for driving the movement of one or more valve members, all of the nozzles described herein could alternatively include a manual mechanism for driving the movement of the valve member(s), wherein the application of a force by the user would be translated into movement of the valve member(s). For example, this could take the form of a rotatable dial or wheel or a sliding dial or switch, with rotation or sliding of the dial by a user causing rotation of a pinion.

The invention claimed is:

1. A nozzle for a fan assembly, the nozzle comprising:

an air inlet;

a first air outlet for emitting an air flow and a second air outlet for emitting an air flow, the first and second air outlets together defining an aggregate air outlet of the nozzle; and a valve for controlling an air flow from the air inlet to the first and second air outlets, wherein the valve comprises one or more valve members that are moveable to adjust the size of the first air outlet relative to the size of the second air outlet while keeping the size of the aggregate air outlet of the nozzle constant, and wherein the first and second air outlets define a pair of slots provided on an elliptical face of the nozzle and are diametrically opposed to one another.

2. The nozzle of claim 1, wherein the one or more valve members are moveable through a range of positions between a first end position in which the first air outlet is maximally occluded and a second end position in which the second air outlet is maximally occluded.

3. The nozzle of claim 1, wherein the first air outlet and the second air outlet are oriented towards a central axis of the face of the nozzle.

4. The nozzle of claim 1, wherein the nozzle comprises an external guide surface adjacent the air outlets and that spans an area between the first and second air outlets.

5. The nozzle of claim 4, wherein the first and second air outlets are oriented to direct an air flow over at least a portion of the external guide surface.

6. The nozzle of claim 4, wherein the external guide surface defines a portion of the first and second air outlets.

7. The nozzle of claim 6, wherein the first outlet is defined by a first portion of a body of the nozzle and a first portion of the external guide surface and the second outlet is defined by a second portion of the body of the nozzle and a second portion of the external guide surface.

8. The nozzle of claim 4, wherein the one or more valve members are pivotally mounted.

9. The nozzle of claim 8, wherein the one or more valve members are pivotally mounted beneath, or adjacent to, the external guide surface.

10. The nozzle of claim 8, wherein the valve comprises a single valve member that is arranged to pivot relative to a body of the nozzle.

11. The nozzle of claim 1, wherein the valve comprises a first valve member and a second valve member that cooperate to adjust the size of the first air outlet relative to the size of the second air outlet while keeping the size of the aggregate air outlet of the nozzle constant.

12. The nozzle of claim 11, wherein the first valve member and the second valve member are linked so that they move simultaneously.

13. The nozzle of claim 11, wherein the first valve member comprises a first valve arm that is arranged to maximally occlude the first air outlet when the first valve member is in the first end position and the second valve member comprise a second valve arm that is arranged to maximally occlude the second air outlet when the valve member is in the second end position.

14. The nozzle of claim 1, wherein the one or more valve members are arranged to move translationally.

15. The nozzle of claim 1, wherein the valve comprises a single valve member that is arranged to be moveable between a first end position in which a first end of the valve member maximally occludes the first air outlet and a second end position in which a second end of the valve member maximally occludes the second air outlet.

16. The nozzle of claim 10, wherein the first and second air outlets define a pair of elongate slots.

17. The nozzle of claim 15, wherein the first and second air outlets define a pair of arcuate slots.

18. A fan assembly comprising an impeller, a motor for rotating the impeller to generate an air flow, and the nozzle of claim 1 for receiving the air flow.

* * * * *